US009863016B2

(12) United States Patent
Takano et al.

(10) Patent No.: US 9,863,016 B2
(45) Date of Patent: Jan. 9, 2018

(54) SUPER NON-MAGNETIC SOFT STAINLESS STEEL WIRE MATERIAL HAVING EXCELLENT COLD WORKABILITY AND CORROSION RESISTANCE, METHOD FOR MANUFACTURING SAME, STEEL WIRE, STEEL WIRE COIL, AND METHOD FOR MANUFACTURING SAME

(71) Applicants: Nippon Steel & Sumikin Stainless Steel Corporation, Tokyo (JP); SUZUKI-SUMIDEN STAINLESS STEEL WIRE CO., LTD., Tokyo (JP)

(72) Inventors: Kohji Takano, Hikari (JP); Yuya Hikasa, Shunan (JP); Masayuki Tendo, Kimitsu (JP); Yoshinori Tada, Hikari (JP); Koichi Yoshimura, Narashino (JP)

(73) Assignees: NIPPON STEEL & SUMIKIN STAINLESS STEEL CORPORATION, Tokyo (JP); SUZUKI-SUMIDEN STAINLESS STEEL WIRE CO., LTD., Tokyo (JP)

( * ) Notice: Subject to any disclaimer, the term of this patent is extended or adjusted under 35 U.S.C. 154(b) by 363 days.

(21) Appl. No.: 14/430,144

(22) PCT Filed: Sep. 26, 2013

(86) PCT No.: PCT/JP2013/076011
§ 371 (c)(1),
(2) Date: Mar. 20, 2015

(87) PCT Pub. No.: WO2014/050943
PCT Pub. Date: Apr. 3, 2014

(65) Prior Publication Data

US 2015/0225806 A1 Aug. 13, 2015

(30) Foreign Application Priority Data

Sep. 27, 2012 (JP) ..... 2012-214059
Sep. 24, 2013 (JP) ..... 2013-197097

(51) Int. Cl.
*C22C 38/58* (2006.01)
*C22C 38/42* (2006.01)
(Continued)

(52) U.S. Cl.
CPC ..... *C21D 9/525* (2013.01); *C21D 6/004* (2013.01); *C21D 6/005* (2013.01); *C21D 6/007* (2013.01);
(Continued)

(58) Field of Classification Search
None
See application file for complete search history.

(56) References Cited

U.S. PATENT DOCUMENTS 5,832,765 A 11/1998 Ohashi
2003/0021716 A1 1/2003 Hauser et al.
(Continued)

FOREIGN PATENT DOCUMENTS

GB 784625 A 10/1957
GB 790303 A 2/1958
(Continued)

OTHER PUBLICATIONS

Machine-English translation JP 2009-030128 A, Hamada Junichi et al., Feb. 12, 2009.*
(Continued)

*Primary Examiner* — Deborah Yee
(74) *Attorney, Agent, or Firm* — Birch, Stewart, Kolasch & Birch, LLP

(57) ABSTRACT

This super non-magnetic soft stainless steel wire rod includes, in mass %, C: 0.08% or less, Si: 0.05% to 2.0%,
(Continued)

Mn: more than 8.0% to 25.0% or less, P: 0.06% or less, S: 0.01% or less, Ni: more than 6.0% to 30.0% or less, Cr: 13.0% to 25.0%, Cu: 0.2% to 5.0%, N: less than 0.20%, Al: 0.002% to 1.5%, and C+N: less than 0.20%, with the remainder being Fe and inevitable impurities, in which Md30, which is expressed as Equation (a) described below, is −150 or less.

$$Md30=413-462(C+N)-9.2Si-8.1Mn-9.5Ni-13.7Cr-29Cu \quad (a)$$

7 Claims, 3 Drawing Sheets

(51) Int. Cl.

| | |
|---|---|
| ***C21D 9/52*** | (2006.01) |
| ***C21D 8/06*** | (2006.01) |
| ***C22C 38/00*** | (2006.01) |
| ***C22C 38/02*** | (2006.01) |
| ***C22C 38/06*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 6/00*** | (2006.01) |
| ***C22C 38/44*** | (2006.01) |
| ***C22C 38/52*** | (2006.01) |
| *C21D 1/26* | (2006.01) |

(52) U.S. Cl.

CPC ..... *C21D 6/008* (2013.01); *C21D 8/06* (2013.01); *C21D 8/065* (2013.01); *C22C 38/001* (2013.01); *C22C 38/002* (2013.01); *C22C 38/005* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 1/26* (2013.01); *Y10T 428/12382* (2015.01)

(56) References Cited

U.S. PATENT DOCUMENTS

| | | | |
|---|---|---|---|
| 2004/0060619 | A1 | 4/2004 | Sakata et al. |
| 2011/0286879 | A1 | 11/2011 | Hirata et al. |

FOREIGN PATENT DOCUMENTS

| | | | | | |
|---|---|---|---|---|---|
| JP | 61-207552 | A | | 9/1986 | |
| JP | 62-156257 | A | | 7/1987 | |
| JP | 4-16241 | B2 | | 3/1992 | |
| JP | 4-272158 | A | | 9/1992 | |
| JP | 6-235049 | A | | 8/1994 | |
| JP | 10-94812 | A | | 4/1998 | |
| JP | 2003-27138 | A | | 1/2003 | |
| JP | 2008-17955 | A | | 1/2008 | |
| JP | 2009-030128 | A | * | 2/2009 | ..... C22C 38/58 |
| JP | 2010-196142 | A | | 9/2010 | |
| JP | 2011-6776 | A | | 1/2011 | |
| JP | 2012-97350 | A | | 5/2012 | |

OTHER PUBLICATIONS

International Search Report, dated Jan. 7, 2014, issued in PCT/JP2013/076011.

Written Opinion of the International Searching Authority, dated Jan. 7, 2014, issued in PCT/JP2013/076011.

Extended European Search Report, dated Mar. 29, 2016, for counterpart European Application No. 13841641.7.

* cited by examiner

SUPER NON-MAGNETIC SOFT STAINLESS STEEL WIRE MATERIAL HAVING EXCELLENT COLD WORKABILITY AND CORROSION RESISTANCE, METHOD FOR MANUFACTURING SAME, STEEL WIRE, STEEL WIRE COIL, AND METHOD FOR MANUFACTURING SAME

TECHNICAL FIELD

The present invention relates to complicatedly shaped products such as electronic equipments, medical device parts, and the like which exhibit high corrosion resistance and for which a super non-magnetic property is required. The present invention relates to an austenitic stainless-steel wire rod (wire material), which includes Mn and Cu so as to greatly enhance γ (austenite) stability and to secure cold workability and a super non-magnetic property in a state of being subjected to cold working and not subjected to any treatment after the cold working, a method for manufacturing the same, a steel wire, a steel wire coil, and a method for manufacturing the same.

The present application claims priority on Japanese Patent Application No. 2012-214059 filed on Sep. 27, 2012, and Japanese Patent Application No. 2013-197097 filed on Sep. 24, 2013, the contents of which are incorporated herein by reference.

BACKGROUND ART

Conventionally, an austenitic stainless steel, typified by SUS304, has been used for parts for which corrosion resistance and a non-magnetic property are required. However, if SUS304 is subjected to working, deformation induced martensite transformation occurs, and magnetic property is generated. For this reason, SUS304 cannot be applied to parts requiring the non-magnetic property.

Conventionally, a high Mn and high N stainless steel, which exhibits a non-magnetic property after working is applied, has been used for parts for which the non-magnetic property is required in a state of being subjected to working and not subjected to any treatment after the working (for example, see Patent Documents 1, 2, and 3).

However, the high Mn and high N stainless steel has high strength, which means that it is difficult to form the high Mn and high N stainless steel into a complicated shape by cold working. Furthermore, if the high Mn and high N stainless steel is formed into a complicated shape by cold working, a very slight amount of deformation induced martensite transformation occurs, and the steel exhibits a low magnetic property. Thus, the super non-magnetic property cannot be obtained.

To deal with this, conventionally, the steel described above is subjected to cutting work so as to have a predetermined shape in order to avoid the occurrence of deformation induced martensite. However, this poses a problem of high cost.

In addition, Cu, Al and the like have been used as additional elements in the case where the steel is used in a state of being subjected to cold working to form the steel into a complicated shape and not subjected to any treatment after the cold working. However, Cu or Al leads to problems, for example, of reduced corrosion resistance, reduced strength.

It should be noted that the super non-magnetic property as used in the present invention represents, for example, a level of a magnetic flux density of 0.01 T or less (preferably, 0.007 T or less) that a product indicates when placed in a magnetic field at 10000 (Oe).

A conventional high Mn and high N stainless steel having non-magnetic property has a magnetic flux density of 0.05 T or less after being subjected to cold working, which satisfies a practical level of a non-magnetic property. However, this does not satisfy a level of a super non-magnetic property that the present invention requires.

Meanwhile, there is proposed a material which is a high Mn stainless steel including Cu and achieving improved cold workability (see, for example, Patent Document 4). However, if this material is subjected to cold working to form the material into a complicated shape as described above, a slight amount of low magnetic property is generated, which poses a problem in that the super non-magnetic property required in the present invention cannot be obtained.

Furthermore, it can be considered to subject a near-net shaped stainless steel wire having a modified shape which is close to the final part shape to molding into a complicatedly shaped product such as a steel wire for a cable connector, and the like. For example, Patent Document 5 describes a technique of subjecting a base wire having a modified cross section to twist working. However, at the time of manufacturing a steel wire coil having a modified cross section with a near net shape, a steel wire having been subjected to shape-modifying work is annealed and coiled, and this causes an inconvenience in that the cross-sectional shape of the steel wire is more likely to be crushed or defects are more likely to occur in the steel wire. This poses a problem in that, substantially, it is not possible to manufacture a soft steel wire coil having a modified cross section with a near net shape, other than that having a simple, plate-like shape.

The conventional high Mn stainless steel wire rod or steel wire is not a material that has, in addition to corrosion resistance, both sufficient cold workability and super non-magnetic property in a state of being subjected to cold working and not subjected to any treatment after the cold working. Furthermore, with a conventional technique, the cross-sectional shape of the steel wire is crushed or defects occur at the time of manufacturing; and therefore, a soft steel wire coil having a modified cross section with a complicated near net shape cannot be substantially manufactured.

PRIOR ART DOCUMENTS

Patent Documents

Patent Document 1: Japanese Unexamined Patent Application, First Publication No. 2011-6776

Patent Document 2: Japanese Unexamined Patent Application, First Publication No. H6-235049

Patent Document 3: Japanese Unexamined Patent Application, First Publication No. S62-156257

Patent Document 4: Japanese Unexamined Patent Application, First Publication No. S61-207552

Patent Document 5: Japanese Unexamined Patent Application, First Publication No. 2008-17955

DISCLOSURE OF THE INVENTION

Problems to be Solved by the Invention

The present invention aims to provide a super non-magnetic soft stainless steel wire rod having excellent cold workability and excellent corrosion resistance, which is favorably used as a base material for a product having a complicated shape and exhibiting high corrosion resistance and the super non-magnetic property, a method for manufacturing the same, a steel wire, a steel wire coil, and a method for manufacturing the same.

Means for Solving the Problem

The present inventors carries out study on various components and processes regarding an austenitic stainless steel to solve the problem described above. As a result, they found the following (1) to (5).

(1) The value of Md30, which is expressed as Equation (a) described below, is reduced so as to greatly improve austenite stability; and thereby, it is possible to completely suppress a deformation induced martensite structure, which is a magnetic substance, after severe cold working is applied.

(2) The contents of C and N are reduced and Cu and Al are added; and thereby, it is possible to suppress work hardening to secure cold workability.

(3) Furthermore, the Mn content is increased and the Ni content is reduced so as to further reduce a base magnetic property of a non-magnetic substance; and thereby, it is possible to obtain a super non-magnetic property.

(4) In addition, an area reduction ratio is specified for wire rod rolling where severe hot working is applied, and conditions for homogenizing thermal treatment applied thereafter is specified. Thereby, microscopic alloy segregation is reduced, and it is possible to stabilize the super non-magnetic property.

(5) Moreover, the cross-sectional shape of a steel wire is set to a specific modified cross-sectional shape, and the steel wire is coiled under a specific condition after strand annealing. Thereby, it is possible to provide a soft steel wire coil having a modified shape close to a final part shape in a state of being subjected to a thermal treatment and not subjected to any treatment after the thermal treatment. The steel wire coil thus obtained can be favorably used for forming a complicatedly shaped part while maintaining the super non-magnetic property.

The present invention has been made on the basis of the findings described above, and has the following features.

(1) A super non-magnetic soft stainless steel wire rod having excellent cold workability and excellent corrosion resistance, including, in mass %: C: 0.08% or less, Si: 0.05% to 2.0%, Mn: more than 8.0% to 25.0% or less, P: 0.06% or less, S: 0.01% or less, Ni: more than 6.0% to 30.0% or less, Cr: 13.0% to 25.0%, Cu: 0.2% to 5.0%, N: less than 0.20%, Al: 0.002% to 1.5%, and C+N: less than 0.20%, with the remainder being Fe and inevitable impurities, wherein Md30, which is expressed as Equation (a) described below, is −150 or less.

$$Md30=413-462(C+N)-9.2Si-8.1Mn-9.5Ni-13.7Cr-29Cu \quad (a),$$

where element symbols in Equation (a) mean the content (mass %) of each of the elements contained in steel.

(2) The super non-magnetic soft stainless steel wire rod having excellent cold workability and excellent corrosion resistance according to (1) described above, further satisfying at least one or more conditions selected from groups A to E described below.

group A: the steel further includes, in mass %, Mo: 3.0% or less, wherein Md30, which is expressed as Equation (b) described below, is −150 or less.

$$Md30=413-462(C+N)-9.2Si-8.1Mn-9.5Ni-13.7Cr-18.5Mo-29Cu \quad (b),$$

where element symbols in Equation (b) mean the content (mass %) of each of the elements contained in steel.

group B: the steel further includes one or more elements, in mass %, selected from:

Nb: 1.0% or less,
V: 1.0% or less,
Ti: 1.0% or less,
W: 1.0% or less, and
Ta: 1.0% or less.

group C: the steel further includes, in mass %, Co: 3.0% or less.

group D: the steel further includes, in mass %, B: 0.015% or less.

group E: the steel further includes one or more elements, in mass %, selected from:

Ca: 0.01% or less,
Mg: 0.01% or less, and
REM: 0.05% or less.

(3) The super non-magnetic soft stainless steel wire rod having excellent cold workability and excellent corrosion resistance according to (1) or (2) described above, wherein in a central portion in a transverse cross section, a standard deviation σ of a variation of a Ni concentration is 5 mass % or less, and a standard deviation σ of a variation of a Cu concentration is 1.5 mass % or less.

(4) The super non-magnetic soft stainless steel wire rod having excellent cold workability and excellent corrosion resistance according to (1) or (2) described above, wherein a tensile strength is 650 MPa or less, and a reduction of an area at tensile rupture is 70% or more.

(5) The super non-magnetic soft stainless steel wire rod having excellent cold workability and excellent corrosion resistance according to (3) described above, wherein a tensile strength is 650 MPa or less, and a reduction of an area at tensile rupture is 70% or more.

(6) A super non-magnetic soft stainless steel wire having excellent cold workability and excellent corrosion resistance, the stainless steel wire having the component composition according to (1) described above, wherein Md30, which is expressed as the Equation (a), is −150 or less.

(7) A super non-magnetic soft stainless steel wire having excellent cold workability and excellent corrosion resistance, the stainless steel wire having the component composition according to (2) described above, wherein Md30, which is expressed as the Equation (a) or the Equation (b), is −150 or less.

(8) The super non-magnetic soft stainless steel wire having excellent cold workability and excellent corrosion resistance according to (6) described above, wherein a tensile strength is 650 MPa or less, and a reduction of an area at tensile rupture is 70% or more.

(9) The super non-magnetic soft stainless steel wire having excellent cold workability and excellent corrosion resistance according to (7) described above, wherein a tensile strength is 650 MPa or less, and a reduction of an area at tensile rupture is 70% or more.

(10) The super non-magnetic soft stainless steel wire having excellent cold workability and excellent corrosion resistance according to any one of (6) to (9) described above, wherein in a central portion in a transverse cross section, a standard deviation σ of a variation of a Ni concentration is 5 mass % or less, and a standard deviation σ of a variation of a Cu concentration is 1.5 mass % or less.

(11) A super non-magnetic soft stainless-steel wire coil having excellent cold workability and excellent corrosion resistance, the coil including the steel wire according to any one of (6) to (9) described above in a coiled state, wherein a cross-sectional shape of the steel wire includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W.

(12) A super non-magnetic soft stainless-steel wire coil having excellent cold workability and excellent corrosion resistance, the coil including the steel wire according to (10) described above in a coiled state, wherein a cross-sectional shape of the steel wire includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W.

(13) A method for manufacturing a super non-magnetic soft stainless steel wire rod having excellent cold workability and excellent corrosion resistance, the method including: subjecting a cast steel having the component composition according to (1) or (2) described above to hot wire-rod rolling at an area reduction ratio of 99% or more; and then, applying homogenizing thermal treatment at a temperature of 1000 to 1200° C.

(14) A method for manufacturing a super non-magnetic soft stainless-steel wire coil having excellent cold workability and excellent corrosion resistance, the method including: subjecting the wire rod according to (1) or (2) described above to wire drawing to obtain a steel wire having a modified cross-sectional shape, in which the cross-sectional shape includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W; applying strand annealing; and then, flanking the steel wire by a pinch roll in a manner such that the first straight portion and the second straight portion are brought into contact with each of paired rolls disposed so as to face each other, passing the steel wire through the pinch roll, and coiling the steel wire.

(15) A method for manufacturing a super non-magnetic soft stainless-steel wire coil having excellent cold workability and excellent corrosion resistance, the method including: subjecting the wire rod according to (3) described above to wire drawing to obtain a steel wire having a modified cross-sectional shape, in which the cross-sectional shape includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W; applying strand annealing; and then, flanking the steel wire by a pinch roll in a manner such that the first straight portion and the second straight portion are brought into contact with each of paired rolls disposed so as to face each other, passing the steel wire through the pinch roll, and coiling the steel wire.

(16) A method for manufacturing a super non-magnetic soft stainless-steel wire coil having excellent cold workability and excellent corrosion resistance, the method including: subjecting the wire rod according to (4) described above to wire drawing to obtain a steel wire having a modified cross-sectional shape, in which the cross-sectional shape includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W; applying strand annealing; and then, flanking the steel wire by a pinch roll in a manner such that the first straight portion and the second straight portion are brought into contact with each of paired rolls disposed so as to face each other, passing the steel wire through the pinch roll, and coiling the steel wire.

(17) A method for manufacturing a super non-magnetic soft stainless-steel wire coil having excellent cold workability and excellent corrosion resistance, the method including: subjecting the wire rod according to (5) described above to wire drawing to obtain a steel wire having a modified cross-sectional shape, in which the cross-sectional shape includes: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W; applying strand annealing; and then, flanking the steel wire by a pinch roll in a manner such that the first straight portion and the second straight portion are brought into contact with each of paired rolls disposed so as to face each other, passing the steel wire through the pinch roll, and coiling the steel wire.

Effects of the Invention

The stainless steel wire rod and the steel wire according to the present invention have a super non-magnetic property, excellent corrosion resistance, and excellent cold workability. Thus, by using this material as a base material, it is possible to achieve an effect of providing a part having excellent corrosion resistance and a super non-magnetic property at a low cost. Furthermore, according to the stainless steel wire coil of the present invention, it is possible to prevent crushing of the cross-sectional shape and the occurrence of defects at the time of manufacturing. Hence, it is possible to provide a soft steel wire having a modified cross section, which can be industrially used as a stainless steel wire having a near net shape. Furthermore, a complicatedly shaped parts such as a cable connector, and the like having the super non-magnetic property can be formed from the steel wire having a modified cross section, which is coiled around the steel wire coil according to the present invention.

EMBODIMENTS FOR CARRYING OUT THE INVENTION

Figure 1:
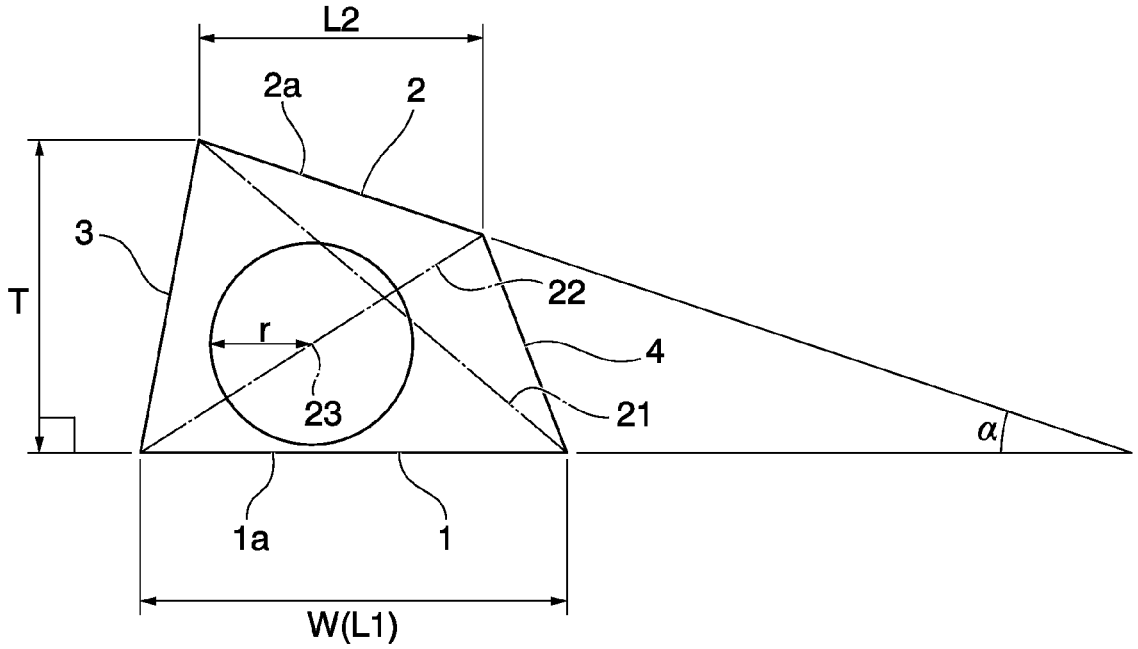
FIG. 1 is a sectional view showing an example of a cross-sectional shape of a steel wire according to this embodiment.

Hereinbelow, an embodiment according to the present invention will be described.

First, reasons for limiting the component composition of a wire rod according to this embodiment will be described.

It should be noted that, in the following description, the symbol "%" means "mass %" unless otherwise specified.

In the case where more than 0.08% of C is added, strength is increased, and cold workability deteriorates. Thus, the upper limit is set to 0.08%, and preferably to 0.05% or less. On the other hand, the excessive reduction in the C content leads to a great increase in manufacturing cost. Thus, it is preferable to set the lower limit to 0.001%, and it is more preferable to set the lower limit to 0.01% or more. The preferable range of the C content is 0.01 to 0.05%.

0.05% or more of Si is added so as to deoxidize, and preferably 0.1% or more of Si is added. However, in the case where more than 2.0% of Si is added, the cold workability deteriorates. Thus, the upper limit of the Si content is set to 2.0%, and preferably to 1.0% or less. The preferable range of the Si content is 0.1 to 1.0%.

More than 8.0% of Mn is added so as to greatly improve austenite stability after cold working, and to obtain the super non-magnetic property, and preferably more than 13.0% of Mn is added. However, in the case where more than 25.0% of Mn is added, its effect is saturated, strength becomes high, and cold workability deteriorates. Thus, the upper limit of the Mn content is set to 25.0%, preferably to 20.0% or less, and more preferably to less than 16.0%. The preferable range of the Mn content is more than 13.0% to 20.0% or less. More preferably, the Mn content is less than 16.0%.

The P content is set to 0.06% or less, and preferably to 0.04% or less in order to secure cold workability. However, from the industrial point of view, it is difficult to make the P content zero. Thus, the preferable range thereof is 0.01% to 0.04%.

The S content is set to 0.01% or less, and preferably to 0.005% or less in order to secure hot manufacturability and corrosion resistance of the wire rod. However, from the industrial point of view, it is difficult to make the S content zero. Thus, the preferable range thereof is 0.0002 to 0.005%.

More than 6.0% of Ni is added so as to greatly improve austenite stability after cold working, and to obtain the super non-magnetic property, and preferably 8.0% or more of Ni is added. However, in the case where more than 30.0% of Ni is added, the number of interatomic bonds of Fe—Ni pairs increases as is the case with the Invar alloy even if the steel is austenitic and has a non-magnetic property; and thereby, the steel exhibits slight magnetic characteristics. Thus, the upper limit of the Ni content is set to 30.0%, preferably to 20.0% or less, and more preferably to less than 10.0%. Since it is preferable to reduce the number of the interatomic bonds of Fe—Ni pairs as much as possible, the preferable range of the Ni content is 8.0% or more to less than 10.0%.

13.0% or more of Cr is added so as to greatly improve austenite stability after cold working, and to obtain the super non-magnetic property and high corrosion resistance, and preferably 15.0% or more of Cr is added. However, in the case where more than 25.0% of Cr is added, δ (delta)-ferrite having a bcc structure, which is a ferromagnetic substance, is generated partially in the steel structure, and the steel exhibits a magnetic property. Furthermore, strength increases, and cold workability deteriorates. For these reasons, the upper limit of the Cr content is limit to 25.0%, and preferably to 20.0% or less. The preferable range of the Cr content is 15.0% to 20.0%.

0.2% or more of Cu is added so as to greatly improve austenite stability after cold working, to obtain the super non-magnetic property, and to suppress work hardening of austenite; and thereby, cold workability is secured. The Cu content is preferably set to 1.0% or more, and more preferably to more than 3.0%. However, in the case where more than 5.0% of Cu is added, significant solidification segregation of Cu occurs; and thereby, hot cracks are caused. As a result, the steel may not be manufactured from an industrial point of view. Thus, the upper limit of the Cu content is limited to 5.0%, and preferably to 4.0% or less. The preferable range of the Cu content is 1.0% to 4.0%, and the more preferable range is more than 3.0% to 4.0% or less.

In the case where 0.20% or more of N is added, strength increases, and the cold workability deteriorates. Thus, the upper limit of the N content is set to less than 0.20%, and preferably to less than 0.10%. On the other hand, excessive reduction in the N content leads to a great increase in manufacturing cost. Thus, the N content is preferably set to 0.001% or more, and more preferably to 0.01% or more. The preferable range of the N content is 0.01% or more to less than 0.10%.

Al is a deoxidizing element, and Al is an important element to suppress work hardening of austenite to secure cold workability as is the case with Cu. 0.002% or more of Al is included, and preferably, 0.01% or more of Al is included. However, even in the case where more than 1.5% of Al is included, its effect is saturated. Furthermore, coarse inclusions are generated, which leads to a deterioration in cold workability. Thus, the upper limit of the Al content is set to 1.5%, preferably to 1.3% or less, and more preferably to 1.2% or less. The preferable range of the Al content is 0.01% to 1.2%.

The content of C+N is limited to less than 0.20% so as to soften the steel to secure cold workability for making a complicatedly shaped part. The content of C+N is preferably set to 0.10% or less.

Md30 is an index obtained by investigating a relationship between components and the amount of deformation induced martensite after cold working. Md30 represents a temperature at which 50% of the microstructure is transformed into martensite when 0.3 of a true tensile strain is applied to a single-phase austenite. The less the Md30 value is, the more stable the austenite becomes, and the generation of martensite can be suppressed. Thus, it is necessary to control the Md30 so as to secure the super non-magnetic property of the wire rod. It is necessary to control the Md30 value to be in a range of −150 or less in order that the wire rod exhibits the super non-magnetic property even after cold working. To this end, the Md30 value is limited to −150 or less. Preferably, the Md30 value is set to −170 or less. More preferably, the Md30 value is set to −200 or less.

Inevitable impurities represent, for example, substances that are contained in raw materials or refractory, and are normally included in the stainless steel during the manufacture, and examples thereof include O: 0.001 to 0.01%, Zr: 0.0001 to 0.01%, Sn: 0.001 to 0.1%, Pb: 0.00005 to 0.01%, Bi: 0.00005 to 0.01%, and Zn: 0.0005 to 0.01%, Next, the reason for limiting the tensile strength and the reduction of an area at tensile rupture of the wire rod according to this embodiment will be described.

In the case where the tensile strength of the wire rod is 650 MPa or less, the cold workability becomes favorable. Furthermore, in the case where the reduction of an area at tensile rupture of the wire rod is 70% or more, the cold workability becomes favorable. Thus, in this embodiment, it is preferable to set the tensile strength of the wire rod to 650 MPa or less, and set the reduction of an area at tensile rupture to 70% or more in order to secure the cold workability.

With regard to a wire rod which is manufactured through the manufacturing method described later using a cast steel having the components described above, the tensile strength and the reduction of an area at tensile rupture fall within the above-described ranges. Furthermore, these mechanical properties can be further improved by more strictly controlling the component composition of the steel in accordance with the required cold workability.

In concrete, by controlling the component composition to filfill Mn: more than 13.0% to 20% or less, Cu: 1.0% to 4.0%, Al: 0.01% to 1.3%, and N: 0.01% or more to less than 0.10%, it is possible to obtain a wire rod having the tensile strength of 590 MPa or less, and the reduction of an area at tensile rupture of 75% or more. By further applying the limitation described above, it is possible to further improve the cold workability of the wire rod.

Next, the reasons for limiting the components contained in the component composition of the wire rod according to this embodiment as needed will be described.

Mo improves corrosion resistance of a product; and therefore, Mo is added as needed, and the Mo content preferably set to 0.01% or more, and more preferably to 0.2% or more. However, in the case where more than 3.0% of Mo is added, the strength increases, and the cold workability deteriorates. Thus, the upper limit of the Mo content is set to 3.0%, and preferably to 2.0% or less. The more preferable range of the Mo content is 0.2 to 2.0%.

Nb, V, Ti, W, and Ta form carbonitrides to improve corrosion resistance, and hence, one or more elements thereof are added as needed. In the case where one or more elements selected from Nb, V, Ti, W, and Ta are contained, the content of each of the elements is preferably set to 0.01% or more, and more preferably to 0.05% or more. In the case where more than 1.0% of each of these elements is added, coarse inclusions are generated, which leads to a deterioration in cold workability. Thus, the upper limit of the content of each of Nb, V, Ti, W, and Ta is set to 1.0%, and preferably to 0.6% or less. The preferable range of the content of each of the elements is 0.05 to 0.6%.

Preferably 0.05% or more of Co, and more preferably 0.2% or more of Co is added as needed so as to greatly improve austenite stability after cold working and to obtain the super non-magnetic property. However, in the case where more than 3.0% of Co is added, the strength becomes high, and the cold workability deteriorates. Thus, the upper limit of the Co content is set to 3.0%, and preferably to 1.0% or less. The more preferable range of the Co content is 0.2 to 1.0%.

0.0005% or more of B, and preferably 0.001% or more of B is added as needed so as to improve hot manufacturability. However, more than 0.015% of B is added, boride is generated, which leads to a deterioration in cold workability. Thus, the upper limit of the B content is set to 0.015%, and preferably to 0.01% or less. The preferable range of the B content is 0.001% to 0.01%.

Ca, Mg, and REM are elements effective in deoxidation, and one or more elements thereof are added as needed. However, in the case where excessive contents of these elements are added, the soft magnetic property deteriorates, and further, coarse deoxidation products are generated, which leads to a deterioration in cold workability. Thus, in the case where Ca is contained, the Ca content is set to 0.01% or less, and preferably to 0.004% or less. In the case where Mg is contained, the Mg content is set to 0.01% or less, and preferably to 0.0015% or less. In the case where REM is contained, the REM content is set to 0.05% or less, and preferably to 0.01% or less. Furthermore, the lower limit of the Ca content is preferably set to 0.0005% or more, and more preferably to 0.001% or more. The lower limit of the Mg content is set to 0.0005% or more, and more preferably to 0.0006% or more. The lower limit of the REM content is preferably set to 0.0005% or more, and more preferably to 0.001% or more. The preferable ranges of the contents of these elements are Ca: 0.001 to 0.004%, Mg: 0.0006 to 0.0015%, and REM: 0.001 to 0.01%.

Next, a method for manufacturing the wire rod according to this embodiment will be described.

The method for manufacturing the wire rod according to this embodiment includes: subjecting a cast steel having any one of the component compositions described above to hot wire-rod rolling at an area reduction ratio of 99% or more; and then, applying homogenizing thermal treatment at a temperature of 11000 to 1200° C.

Unlike the rolling performed to a thin sheet, a thick sheet, a steel pipe, and a bar, hot working can be severely applied in the rolling performed to a wire rod having a small diameter. The hot wire-rod rolling and the homogenizing thermal treatment are effective for making the wire rod uniform to stabilize the super non-magnetic property. In particular, in order to obtain the soft wire rod according to this embodiment, which stably exhibits the super non-magnetic property after cold working, it is necessary to subject a cast steel having the above-described component composition to hot wire-rod rolling at an area reduction ratio of 99% or more in total, which is a greatly high area reduction ratio, and then, to apply homogenizing thermal treatment at a temperature of 1000 to 1200° C.

In the case where the total of the area reduction ratio of hot wire-rod rolling is less than 99%, the material lacks uniformity, and it is difficult to obtain the super non-magnetic property. Thus, the area reduction ratio of the hot wire-rod rolling is set to 99% or more, and more preferably to 99.5 to 99.99%.

In the case where the temperature of the homogenizing thermal treatment after the hot wire-rod rolling is lower than 1000° C., the strength increases, and cold workability deteriorates, and furthermore, the material lacks uniformity; and therefore, the super non-magnetic property deteriorates. Thus, the temperature of the homogenizing thermal treatment is set to 1000° C. or higher, preferably to 1050° C. or higher. On the other hand, in the case where the temperature of the homogenizing thermal treatment is higher than 1200° C., a ferrite phase, which is a ferromagnetic substance, precipitates; and thereby, the super non-magnetic property deteriorates. Thus, the temperature of the homogenizing thermal treatment is set to 1200° C. or lower, preferably to 1150° C. or lower. The temperature of the homogenizing thermal treatment is limited to 1000 to 1200° C., and preferably to 1050 to 1150° C.

Next, the steel wire according to this embodiment will be described.

The effects obtained from the wire rod according to this embodiment are not limited to the steel wire rod but also can be achieved by a steel wire obtained by drawing the steel wire rod. From the viewpoint of material, the steel wire according to this embodiment has characteristics similar to those of the steel wire rod. In other words, the steel wire according to this embodiment has the component composition and the Md30 value, which are similar to those of the steel wire rod described above, and furthermore, the steel wire exhibits the super non-magnetic property.

In order to secure cold workability as is the case with the steel material, it is preferable that the steel wire according to this embodiment has a tensile strength of 650 MPa or less, and a reduction of an area at tensile rupture of 70% or more. These characteristics can be obtained by manufacturing the steel wire according to this embodiment using the steel wire rod according to this embodiment as a base material.

Moreover, by controlling the component composition to be Mn: more than 13.0% to 20% or less, Cu: 1.0% to 4.0%, Al: 0.01% to 1.3%, and N: 0.01 or more to less than 0.10% as is the case with the steel wire rod, it is possible to obtain the steel wire having a tensile strength of 590 MPa or less, and a reduction of an area at tensile rupture of 75% or more. By making the steel wire as described above, it is possible to further improve cold workability.

Next, reasons for limiting the distributions of the concentrations of Ni and Cu in the wire rod and the steel wire according to this embodiment will be described.

Ni or Cu has an effect on a magnetic property of a paramagnetic steel. In the case where, in the central portion in the transverse cross section of the wire rod or the steel wire, the standard deviation σ of the variation of the Ni concentration is 5% or less, and the standard deviation σ of the variation of the Cu concentration is 1.5% or less, it is possible to prevent highly magnetized areas from being locally formed; and therefore, it is possible to stably obtain the super non-magnetic property. Thus, it is preferable to set the standard deviation σ of the variation of the Ni concentration to be in a range of 5% or less, and to set the standard deviation σ of the variation of the Cu concentration to be in a range of 1.5% or less. More preferably, the standard deviation σ of the variation of the Ni concentration is set to be in a range of 3% or less, and the standard deviation σ of the variation of the Cu concentration is set to be in a range of 1.0% or less.

It should be noted that the standard deviation σ of the variation of the Ni concentration or the Cu concentration in the central portion in the transverse cross section of the wire rod or the steel wire is obtained from results of map analysis of the Ni concentration and the Cu concentration at an arbitrary portion in the central area in the transverse cross section of the wire rod or the steel wire through the electron probe microanalysis (EPMA).

In the case where the transverse cross-sectional shape is a circle, the central area in the transverse cross section of the wire rod or the steel wire means an area extending from the center of the circle and surrounded by a circle having a radius of one quarter of the diameter of the wire rod or the steel wire.

Furthermore, in the case where the transverse cross-sectional shape is a regular polygon and the number of sides are four or more, the central area in the transverse cross of the wire rod or the steel wire means an area extending from the center of the regular polygon and surrounded by a circle having a radius of one quarter of the length of a diagonal line passing through the center of the regular polygon.

In addition, in the case where the transverse cross-sectional shape has a modified cross-sectional shape shown in FIGS. 1 to 3, which forms a steel wire coil described later, the central area in the transverse cross of the wire rod or the steel wire means the following area. First, a first diagonal line 21 is drawn, which is a line connecting between one end of a first straight portion 1*a* (11*a*) and one end portion of a second straight portion 2*a* (12*a*), this one end portion being a farther end portion of the second straight portion 2*a* (12*a*)

relative to the one end of the first straight portion 1*a* (11*a*). Furthermore, a second diagonal line 22 is drawn, which is a line connecting between the other end of the first straight portion 1*a* (11*a*) and one end portion of the second straight portion 2*a* (12*a*), this one end portion being a farther end portion of the second straight portion 2*a* (12*a*) relative to the other end of the first straight portion 1*a* (11*a*). Then, the central area in the transverse cross section is set to an area surrounded by a circle having a radius r which is one quarter of the length of the shorter diagonal line of the first diagonal line 21 and the second diagonal line 22 with the central position 23 of the shorter diagonal line (second diagonal line 22 in FIG. 1) of the first diagonal line 21 and the second diagonal line 22 in the lengthwise direction being the center.

The method for manufacturing the steel wire according to this embodiment is not specifically limited, and a general method can be applied. Examples of the general method for manufacturing the steel wire include a method including a step of drawing the steel wire rod according to this embodiment at a drawing reduction ratio of 10 to 95%, and a step of applying strand annealing at a temperature of 900 to 1200° C. for five seconds to 24 hours.

In order to increase the dimensional accuracy of the steel wire, the drawing reduction ratio for the steel wire rod is preferably set to 10% or more, and more preferably to 20% or more. Furthermore, in order to prevent breakage during wire drawing, the drawing reduction ratio for the steel wire rod is preferably set to 95% or less and more preferably to 90% or less.

In order to remove strains occurring during the wire drawing step, the temperature of the strand annealing is preferably set to 900° C. or higher, and more preferably to 1000° C. or higher. Furthermore, in order to prevent precipitation of ferrite phases, which are ferromagnetic substances, the temperature of the strand annealing is preferably set to 1200° C. or lower, and more preferably to 1150° C. or lower.

In order to sufficiently achieve an annealing effect, the annealing time of the strand annealing is preferably set to 5 seconds or longer, and more preferably to 20 seconds or longer. Furthermore, in order to improve productivity, the annealing time of the strand annealing is preferably set to 24 hours or shorter, and more preferably to one hour or shorter.

The cross-sectional shape of the steel wire according to this embodiment is not specifically limited, and may be a circle or be a modified cross-sectional shape such as a polygon and the like. In the case where the steel wire according to this embodiment has a modified cross-sectional shape, it is preferable that the steel wire has the cross-sectional shape described later in order to prevent the cross-sectional shape from deforming due to coiling performed after the strand annealing.

Next, the steel wire coil according to this embodiment will be described.

The steel wire coil according to this embodiment is obtained by coiling the steel wire according to this embodiment having a specific cross-sectional shape under a specific condition.

At the time of forming the steel wire into a complicated shape, it is preferable to form the steel wire into a near net shape which is a shape close to the final product. However, if the steel wire is formed into a modified cross-sectional shape serving as the near net shape, there is a fear that the cross-sectional shape of the steel wire is crushed in the case where a wire rod is subjected to wire drawing to obtain a steel wire having a modified cross-sectional shape, strand annealing is conducted, and then the steel wire is coiled. Therefore, according to the steel wire coil of this embodiment, the steel wire is formed into the cross-sectional shape described below so that the cross-sectional shape is not crushed even in the case where the steel wire is coiled after the strand annealing.

FIG. 1 is a sectional view showing an example of the cross-sectional shape of the steel wire coiled into the steel wire coil according to this embodiment. The cross-sectional shape shown in FIG. 1 is a rectangle, and the cross-sectional shape includes: a first side 1 having a first straight portion 1*a*; a second side 2 having a second straight portion 2*a* sloped at an angle (a) of 30° or less relative to the first straight portion 1*a* and placed so as to face the first straight portion 1*a*; a third side 3 including a straight line connecting between one end of the first side 1 and one end portion of the second side 2, this one end portion being an end portion of the second side 2 closer to the one end of the first side 1; and a fourth side 4 including a straight line connecting between the other end of the first side 1 and one end portion of the second side 2, this one end portion being an end portion of the second side 2 closer to the other end of the first side 1.

In the cross-sectional shape shown in FIG. 1, the angle $\alpha$ formed by a direction in which the first straight portion 1*a* extends and a direction in which the second straight portion 2*a* extends is 30° or less. In the example shown in FIG. 1, the second straight portion 2*a* is placed so as to be sloped at an angle relative to the first straight portion 1*a*. However, the second straight portion 2*a* of the second side 2 may be in parallel to the first straight portion 1*a*.

In general, strand annealing is applied to a steel wire having a modified cross-sectional shape which is obtained by subjecting a wire rod to wire drawing. The steel wire subjected to the strand annealing is passed through a pinch roll having a pair of rolls disposed so as to face each other, and is conveyed in a predetermined conveying direction. Then, the steel wire is delivered to a cylindrical drum around which the steel wire is coiled, and is coiled therearound. The coiled steel wire is removed from the cylindrical drum, and is released from tension caused at the time of coiling; and thereby, a steel wire coil is obtained.

In the case where the angle $\alpha$ formed by the direction in which the first straight portion 1*a* extends and the direction in which the second straight portion 2*a* extends is more than 30° in the cross-sectional shape shown in FIG. 1, stress from the pinch roll concentrates on an apex portion of the rectangle in the cross-sectional shape of the steel wire when the first straight portion 1*a* and the second straight portion 2*a* are brought into contact with each of the paired rolls disposed in the pinch roll so as to face each other, and the steel wire is passed through the pinch roll in a state where the steel wire is flanked by the paired rolls of the pinch roll in the method for manufacturing a steel wire coil described later. This may lead to deformation of the apex portion of the cross-sectional shape of the steel wire, or the occurrence of defects in the steel wire.

Furthermore, in the case where the angle $\alpha$ described above is more than 30°, it is difficult to sufficiently bring the first straight portion 1*a* and the second straight portion 2*a* into contact with each of the paired rolls of the pinch roll; and thereby, the state in which the steel wire is flanked by the paired rolls becomes unstable. Thus, even if the steel wire is passed through the pinch roll, it is not possible to sufficiently achieve the function of controlling the steel wire in the conveying direction with the pinch roll.

Moreover, in the case where the angle $\alpha$ described above is more than 30°, it is difficult to bring the first straight portion 1*a* and the second straight portion 2*a* of each of the steel wires adjacent to each other and coiled around the cylindrical drum into face contact with each other. This creates a situation in which steel wires adjacent to each other and coiled around the cylindrical drum are more likely to be brought into point contact with each other when viewed in cross section. In the case where the steel wires adjacent to each other are brought into point contact with each other when viewed in cross section, and are coiled, there is a fear that portions of the steel wires brought into point contact with each other are crushed and deformed due to tension at the time of coiling the steel wires, or defects occur in the steel wires.

Furthermore, in the case where the angle α described above is more than 30°, the state where the steel wire described above is flanked by the paired rolls becomes unstable. This may create a situation in which the steel wire being conveyed rotates, and the apex portions of the rectangle of the cross-sectional shape of the steel wire are brought into contact with the paired rolls of the pinch roll. In such a case, there is a fear that the apex portions of the rectangle of the cross-sectional shape of the steel wire are crushed to deform, or defects occur in the steel wire.

It should be noted that, in the case where no pinch roll is disposed, the steel wire is not deformed due to a stress from the pinch roll. However, if no pinch roll is disposed, the steel wire rotates and twists at the time of coiling the steel wire around the cylindrical drum; and thereby, a situation where the steel wires adjacent to each other and coiled around the cylindrical drum are more likely to be brought into point contact with each other when viewed in cross section. Thus, the cross-sectional shape of the steel wire is crushed to deform due to a tension at the time of coiling the steel wire, or defects occur in the steel wire.

In the cross-sectional shape shown in FIG. 1, the angle α described above is 30° or less; and therefore, stress from the pinch roll is less likely to concentrate on the apex portions of the rectangle of the cross-sectional shape of the steel wire. Thus, the apex portions of the rectangle of the cross-sectional shape of the steel wire are less likely to be crushed to deform, or defects are less likely to occur in the steel wire.

Furthermore, in the case where the angle α described above is 30° or less, the state where the steel wire describe above is flanked by the paired rolls becomes stable. Thus, the first straight portion 1*a* and the second straight portion 2*a* of the steel wires adjacent to each other are more likely to be brought into face contact with each other in the steel wire coil after coiled. As a result, by setting the angle described above to 30° or less, it is possible to effectively prevent the steel wire after strand annealing from being crushed to deform, or prevent defects from occurring in the steel wire.

Furthermore, in order to more effectively prevent the crushing of the steel wire or the occurrence of defects in the steel wire, it is preferable to set the angle described above to 15° or less, and most preferably to 0° (the second straight portion 2*a* of the second side 2 and the first straight portion 1*a* are parallel to each other).

In addition, in the steel wire shown in FIG. 1, a ratio (T/W) of a first dimension (T), which is the maximum dimension of the cross-sectional shape in a direction perpendicular to the first straight portion 1*a*, relative to a second dimension (W), which is the maximum dimension of the cross-sectional shape in a direction parallel to the first straight portion 1*a*, is set to 3 or less. In the case where the ratio (T/W) described above is more than 3, the state where the steel wire described above is flanked by the paired rolls becomes unstable. In the case where the ratio (T/W) is 3 or less, the state where the steel wire described above is flanked by the paired rolls becomes stable; and thereby, it is possible to prevent the crushing of the steel wire or the occurrence of defects in the steel wire. In order to further stabilize the state where the steel wire described above is flanked by the paired rolls and more effectively prevent the crushing of the steel wire or the occurrence of defects in the steel wire, it is preferable to set the ratio (T/W) described above to 1.5 or less, and more preferably to 1 or less.

Moreover, in the steel wire shown in FIG. 1, the length L1 of the first side 1 (which is the same as the maximum dimension (W) in the direction parallel to the first straight portion 1*a* in FIG. 1) is equal to or longer than the length L2 of the second side 2, and the length L1 of the first side 1 and the length L2 of the second side 2 relative to the second dimension (W) each fall within a range of W/10 to W. In the case where each of the length L1 of the first side 1 and the length L2 of the second side 2 is less than W/10, the state where the steel wire described above is flanked by the paired rolls becomes unstable. In the case where each of the length L1 of the first side 1 and the length L2 of the second side 2 falls within the range described above, the state where the steel wire described above is flanked by the paired rolls becomes stable; and thereby, it is possible to prevent the crushing of the steel wire or the occurrence of defects in the steel wire. In order to prevent the crushing of the steel wire or the occurrence of defects in the steel wire in a more effective manner, it is preferable to set the length L1 of the first side 1 and the length L2 of the second side 2 to be in a range of W/5 to W.

The steel wire coil according to this embodiment is obtained by coiling the steel wire having the cross-sectional shape shown in FIG. 1. Thus, at the time of manufacture, stress from the pinch roll is less likely to concentrate on the apex portions of the rectangle of the cross-sectional shape of the steel wire, even in the case where the first straight portion 1*a* and the second straight portion 2*a* are brought into contact with each of the paired rolls disposed in the pinch roll so as to face each other, and the steel wire is passed through the pinch roll in a state where the steel wire is flanked by the paired rolls. Furthermore, according to the steel wire coil of this embodiment, the state where the steel wire is flanked by the paired rolls becomes stable. This creates a situation where, after coiling, in the steel wire coil, the first straight portion 1*a* and the second straight portion 2*a* of the steel wires adjacent to each other are more likely to be brought into face contact with each other.

With these configurations, according to the steel wire coil of this embodiment, it is possible to prevent the crushing of the cross-sectional shape of the steel wire or the occurrence of defects in the steel wire during manufacturing. Furthermore, the steel wire coil according to this embodiment consists of a soft steel wire having a modified cross-sectional shape that can be used as a stainless steel wire having a near net shape; and therefore, the steel wire coil according to this embodiment is favorably formed into a complicatedly shaped part having the super non-magnetic property.

The cross-sectional shape of the steel wire coiled into the steel wire coil according to this embodiment is not limited to the example shown in FIG. 1.

Figure 2:
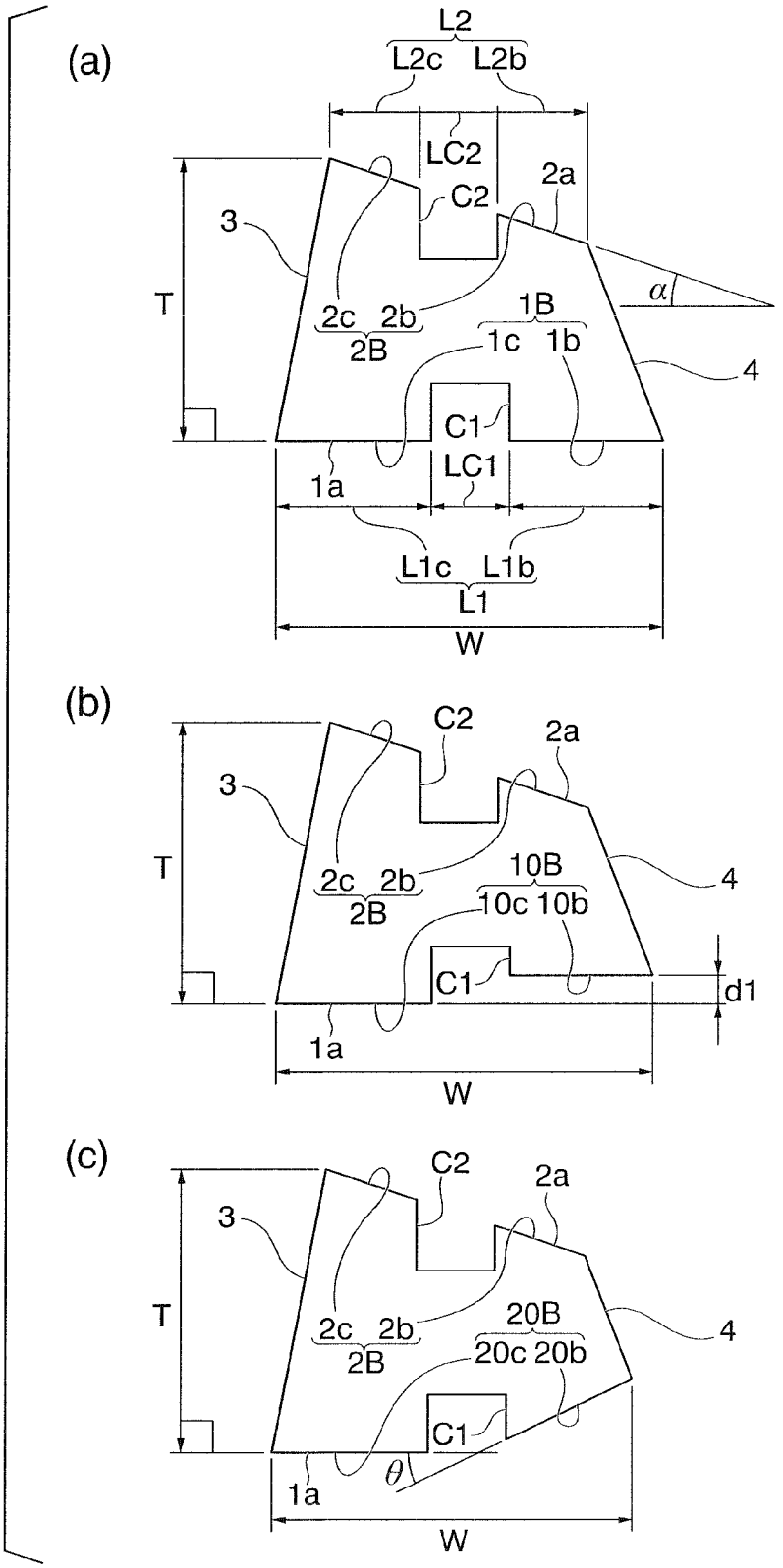
FIGS. 2(*a*) to 2(*c*) are sectional views showing other examples of a cross-sectional shape of the steel wire according to this embodiment.

FIGS. 2(*a*) to 2(*c*) are sectional views showing other examples of the cross-sectional shape of the steel wire according to this embodiment.

The cross-sectional shape of the steel wire shown in FIG. 2(*a*) is different from the cross-sectional shape of the steel wire shown in FIG. 1 only in that a recessed portion C1 is formed on a first side 1B and a recessed portion C2 is formed on a second side 2B. Thus, in FIG. 2(*a*), the same reference characters are attached to the same portions as those in FIG. 1, and the explanation thereof will not be repeated.

The recessed portion as shown in FIG. 2(*a*) may be formed on both of the first side 1B and the second side 2B, or may be formed on either one of the first side 1B or the second side 2B. Furthermore, the recessed portion may be formed on the third side 3 and/or the fourth side 4. Moreover, the number of recessed portions existing in each of the sides may be one as shown in FIG. 2(*a*), or may be two or more.

In the steel wire having the cross-sectional shape shown in FIG. 2(*a*), the first side 1B includes a first side portion 1*b* and a second side portion 1*c*, which are located on both sides of the recessed portion C1 and extends on the same straight line. The first side portion 1*b* and the second side portion 1*c* may have the same length, or may have different lengths.

The recessed portion C1 having the width dimension of W/10 or longer does not involve in contact between steel wires adjacent to each other in a coiled state, or contact between the first straight portion 1*a* and the paired rolls of the pinch roll. Therefore, in the case where the recessed portion C1 having the width dimension of W/10 or longer is formed on the first side 1B as shown in FIG. 2(*a*), the width dimension LC1 of the recessed portion C1 is not included in the length L1 of the first side 1B. Thus, the length L1 of the first side 1B in the cross-sectional shape shown in FIG. 2(*a*) is equal to the length obtained by adding up the length L1*b* of the first side portion 1*b* and the length L1*c* of the second side portion 1*c*, which extend on the same straight line.

In the steel wire having the cross-sectional shape shown in FIG. 2(*a*), the second side 2B includes a first side portion 2*b* and a second side portion 2*c*, which are located on both sides of the recessed portion C2 and extend on the same straight line. The first side portion 2*b* and the second side portion 2*c* may have the same length, or may have different lengths.

The recessed portion C2 having the width dimension of W/10 or longer does not involve in contact between steel wires adjacent to each other in a coiled state, or contact between the second straight portion 2*a* and the paired rolls of the pinch roll. Therefore, in the case where the recessed portion C2 having the width dimension of W/10 or longer is formed on the second side 2B, the width dimension LC2 of the recessed portion C2 is not included in the length L2 of the second side 2B. Thus, the length L2 of the second side 2B in the cross-sectional shape shown in FIG. 2(*a*) is equal to the length obtained by adding up the length L2*b* of the first side portion 2*b* and the length L2*c* of the second side portion 2*c*, which extend on the same straight line.

It should be noted that, in the case where the width dimension of each of the recessed portions C1 and C2 in the cross-sectional shape is less than W/10, even if the recessed portion is formed on the first side 1B and/or the second side 2B, it is possible to neglect the effect thereof on contact between steel wires adjacent to each other in the coiled state. Furthermore, in the case where the width dimension of each of the recessed portions C1 and C2 in the cross-sectional shape is less than W/10, it is also possible to neglect the effect of the recessed portions on stability of the state where the first straight portion 1*a* and the second straight portion 2*a* are brought into contact with each of the paired rolls disposed in the pinch roll so as to face each other. Thus, in the case where the width dimension of the recessed portion C1 in the cross-sectional shape is less than W/10, the width dimension of the recessed portion C1 is included in the length L1 of the first side 1B. In addition, in the case where the width dimension of the recessed portion C2 in the cross-sectional shape is less than W/10, the width dimension of the recessed portion C2 is included in the length L2 of the second side 2B.

The steel wire having the cross-sectional shape shown in FIG. 2(*a*) includes the first side 1B having the first straight portion 1*a*, and the second side 2B having the second straight portion 2*a* sloped at an angle (a) of 30° or less relative to the first straight portion 1*a* and disposed so as to face the first straight portion 1*a*. Furthermore, in the steel wire having the cross-sectional shape shown in FIG. 2(*a*), the ratio (T/W) of the first dimension (T), which is the maximum dimension of the cross-sectional shape in a direction perpendicular to the first straight portion 1*a*, relative to the second dimension (W), which is the maximum dimension of the cross-sectional shape in a direction parallel to the first straight portion 1*a* (in FIG. 2, the length obtained by adding up the length L1*b* of the first side portion 1*b*, the width dimension LC1 of the recessed portion C1, and the length L1*c* of the second side portion 1*c*), is set to 3 or less. Moreover, in the steel wire having the cross-sectional shape shown in FIG. 2(*a*), the length L1 of the first side 1B is equal to or longer than the length L2 of the second side 2B, and the length L1 of the first side 1B and the length L2 of the second side 2B relative to the second dimension (W) each fall within a range of W/10 to W.

Thus, in the case of the steel wire coil into which the steel wire having the cross-sectional shape shown in FIG. 2(*a*) is coiled, it is possible to prevent the crushing of the cross-sectional shape of the steel wire or the occurrence of defects in the steel wire during manufacturing as is the case with the steel wire coil into which the steel wire having the cross-sectional shape shown in FIG. 1 is coiled.

Furthermore, the steel wire having the cross-sectional shape shown in FIG. 2(*a*) has the recessed portion C1 formed on the first side 1B and the recessed portion C2 formed on the second side 2B. Thus, the steel wire coil, into which the steel wire having the cross-sectional shape shown in FIG. 2(*a*) is coiled, is suitable for a stainless steel wire having a near net shape such as a cable connector and the like.

Furthermore, in the cross-sectional shape of the steel wire coiled into the steel wire coil according to this embodiment, the first side portion and the second side portion of the first side (and/or the second side) may extend on the same straight line as shown in FIG. 2(*a*), or may be extend on different straight lines as is the case with the first side shown in FIGS. 2(*b*) and 2(*c*).

In the cross-sectional shape shown in FIG. 2(*b*), a first side portion 10*b* and a second side portion 10*c* of a first side 10B are in parallel to each other. In this case, if, in a direction perpendicular to the first straight portion 1*a*, the dimension d1 between a position of a direction in which the first side portion 10*b* extends and a position of a direction in which the second side portion 10*c* extends is equal to or shorter than 1/10 of the first dimension (T), it is possible to obtain an effect similar to that obtained by the cross-sectional shape shown in FIG. 2(*a*) even if the first side portion 10*b* and the second side portion 10*c* of the first side 10B extend on different straight lines.

It should be noted that, in FIG. 2(*b*), description has been made by giving an example in which the first side portion 10*b* and the second side portion 10*c* of the first side 10B extend on different straight lines. However, the first side portion and the second side portion of the second side may extend on different straight lines. In the case where the first side portion and the second side portion of the second side extend in different directions, and the first side portion and the second side portion are in parallel to each other, it is possible to obtain an effect similar to that obtained by the cross-sectional shape shown in FIG. 2(*a*) if, in a direction perpendicular to the first straight portion 1*a*, the dimension between a position of a direction in which the first side portion of the second side extends and a position of a direction in which the second side portion extends is equal to or shorter than 1/10 of the first dimension (T).

Furthermore, as shown in FIG. 2(*c*), in the case where a first side portion 20*b* and a second side portion 20*c* of a first side 20B are located on both sides of the recessed portion C1 and extend on different straight lines, and the first side portion 20*b* and the second side portion 20*c* are not in parallel to each other, it is possible to obtain a similar effect to that obtained by the cross-sectional shape shown in FIG. 2(*a*) if an angle θ of a direction in which the second side portion 20*c* extends, relative to a direction in which the first side portion 20*b* extends is 30° or less. In other words, the first side portion 20*b* and the second side portion 20*c* may be inclined relatively to each other in a way that forms a mountain as shown in FIG. 2(*c*), or may be inclined relatively to each other in a way that forms a valley.

It should be noted that, in the case were the first side portion 20*b* and the second side portion 20*c* are not in parallel to each other, the direction in which the first straight portion 1*a* extends represents a direction in which a longer side portion (the second side portion 20*c* in the case of FIG. 2(*c*)) of the first side portion 20*b* and the second side portion 20*c* extends. Note that, in the case where the first side portion and the second side portion have the same length, the direction in which the first straight portion 1*a* extends represents a direction in which a side portion having a longer second dimension (W), which is obtained by measuring the second dimension on the basis of each of the first side portion and the second side portion, extends.

It should be noted that, in FIG. 2(*c*), description has been made by giving an example in which the first side portion 20*b* and the second side portion 20*c* of the first side 20B extend on different straight lines, and the first side portion 20*b* and the second side portion 20*c* of the first side 20B are not in parallel to each other. However, it may be possible to employ a configuration in which the first side portion and the second side portion of the second side also extend on different straight lines and are not in parallel to each other. In this case, it is possible to obtain a similar effect to that obtained by the cross-sectional shape shown in FIG. 2(*a*) if both of the first side portion and the second side portion of the second side are sloped at an angle of 30° or less relative to the direction in which the first straight portion 1*a* extends.

It should be noted that, in the case where there are two or more straight lines that face the first straight portion 1*a*, the second straight portion 2*a* is determined on the basis of the following (1) to (4).

(1) In the case where there is one straight line that is sloped at an angle of 30° or less relative to the first straight portion 1*a*, this straight line is determined to be the second straight portion 2*a*.

(2) In the case where there are a plurality of straight lines that are sloped at an angle of 30° or less relative to the first straight portion 1*a*, the straight line having the longest length is determined to be the second straight portion 2*a*.

(3) In the case where there are a plurality of straight lines that are sloped at an angle of 30° or less relative to the first straight portion 1*a* and there are two or more straight lines that have the longest length, the straight line having the smallest angle difference with respect to the first straight portion 1*a* among these straight lines is determined to be the second straight portion 2*a*.

(4) In the case where there are a plurality of straight lines that are sloped at an angle of 30° or less relative to the first straight portion 1*a*, there are two or more straight lines that have the longest length, and there are two or more straight lines having the smallest angle difference with respect to the first straight portion 1*a* among these straight lines, any one of these straight lines may be determined to be the second straight portion 2*a*.

Figure 3:
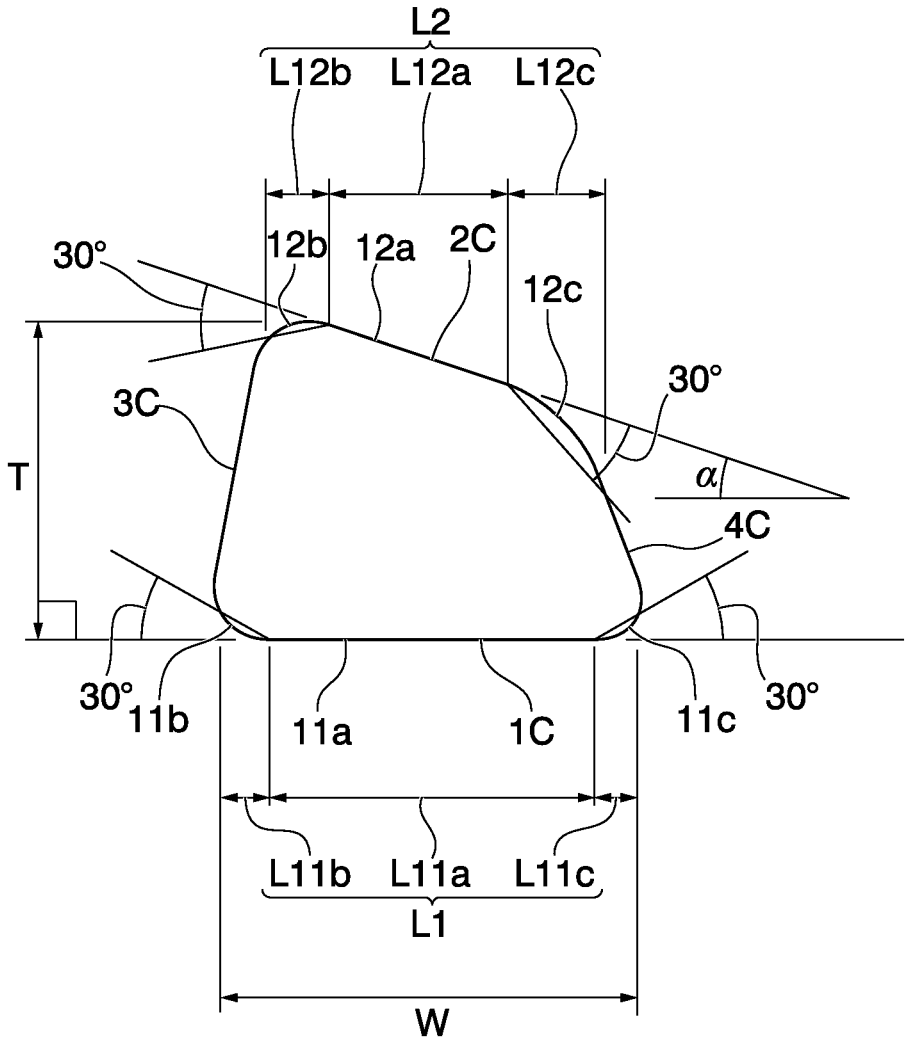
FIG. 3 is a sectional view showing another example of a cross-sectional shape of the steel wire according to this embodiment.

FIG. 3 is a sectional view showing another example of the cross-sectional shape of the steel wire according to this embodiment. The cross-sectional shape of the steel wire shown in FIG. 3 differs from the cross-sectional shape shown in FIG. 1 in that both end portions of each side 1C, 2C, 3C, and 4C are formed into a curved shape, and one side and another side are connected with a smoothly curved line.

The first side 1C shown in FIG. 3 includes a first straight portion 11*a* disposed at the center thereof in the lengthwise direction. Furthermore, the second side 2C includes a second straight portion 12*a* disposed at the center thereof in the lengthwise direction. The first straight portion 11*a* and the second straight portion 12*a* are disposed so as to face each other. The second straight portion 12*a* is sloped at an angle (α) of 30° or less relative to the first straight portion 11*a* as is the case with the cross-sectional shape shown in FIG. 1.

Furthermore, in the cross-sectional shape shown in FIG. 3, a ratio (T/W) of the first dimension (T), which is the maximum dimension in a direction perpendicular to the first straight portion 11*a*, relative to the second dimension (W), which is the maximum dimension of the cross-sectional shape in a direction parallel to the first straight portion 11*a*, is set to 3 or less.

As shown in FIG. 3, in the case where either one or both of the end portions of the first side 1C (and/or the second side 2C) are curved lines, contact areas 11*b*, 11*c*, 12*b*, and 12*c*, which will be described later, of the curved lines facilitate face contact between steel wires adjacent to each other in a coiled state, and have a function of improving stability of the state where the steel wire is flanked by the paired rolls of the pinch roll.

Thus, on the first side 1C shown in FIG. 3, the length L1 of the first side 1C represents the total dimension of the length L11*a* of the first straight portion 11*a* and the lengths L11*b* and L11*c* of the curved contact areas 11*b* and 11*c*. Furthermore, on the second side 2C shown in FIG. 3, the length L2 of the second side 2C represents the total dimension of the length L12*a* of the second straight portion 12*a* and the lengths L12*b* and L12*c* of the curved contact areas 12*b* and 12*c*.

The contact area 11*b*, 11*c* (12*b*, 12*c*) of the curved line represents a range extending from the end portion of the first straight portion 11*a* (or the second straight portion 12*a*) to a point of intersection between the curved line and a straight line extending from the end portion of the first straight portion 11*a* (or the second straight portion 12*a*) and sloped at an angle of 30° relative to the first straight portion 11*a* (or the second straight portion 12*a*).

In the cross-sectional shape shown in FIG. 3, the length L1 of the first side 1C is equal to or longer than the length L2 of the second side 2C, and the length L1 of the first side 1C and the length L2 of the second side 2C relative to the second dimension (W) each fall within a range of W/10 to W.

The steel wire having the cross-sectional shape shown in FIG. 3 includes the first side 1C having the first straight portion 11*a* and the second side 2C having the second straight portion 12*a* sloped at the angle (a) of 30° or less relative to the first straight portion 11*a* and disposed so as to face the first straight portion 11*a*; the ratio (T/W) of the first dimension (T), which is the maximum dimension of the cross-sectional shape in a direction perpendicular to the first straight portion 11*a*, relative to the second dimension (W), which is the maximum dimension of the cross-sectional shape in a direction parallel to the first straight portion 11*a*, is set to 3 or less; the length L1 of the first side 1C is equal to or longer than the length L2 of the second side 2C; and the length L1 of the first side 1C and the length L2 of the second side 2C relative to the second dimension (W) each fall within a range of W/10 to W.

Thus, in the case of a steel wire coil into which the steel wire having the cross-sectional shape shown in FIG. 3 is coiled, it is possible to prevent the crushing of the cross-sectional shape of the steel wire and the occurrence of defects in the steel wire during manufacturing as is the case with the steel wire coil into which the steel wire having the cross-sectional shape shown in FIG. 1 is coiled.

Moreover, in the steel wire having the cross-sectional shape shown in FIG. 3, the sides 1C, 2C, 3C, and 4C are each connected through a smoothly curved line; and therefore, it is possible to further reduce the possibility of concentrating stress from the pinch roll on the apex portions of the cross-sectional shape of the steel wire. In addition, the state where the first straight portion 11*a* and the second straight portion 12*a* are brought into contact with each of the paired rolls disposed in the pinch roll so as to face each other becomes more stable. Therefore, with regard to the steel wire coil into which the steel wire having the cross-sectional shape shown in FIG. 3 is coiled, it is possible to further prevent the crushing of the cross-sectional shape of the steel wire and the occurrence of defects in the steel wire during manufacturing.

It should be noted that the shape of the steel wire constituting the steel wire coil according to this embodiment is not limited to the cross-sectional shapes shown in FIG. 1 to FIG. 3, and various modifications are possible without departing from the features thereof.

Next, a method for manufacturing the steel wire coil according to this embodiment will be described.

In the manufacturing of the steel wire coil according to this embodiment, at first, a wire rod according to this embodiment having the component composition described above is subjected to wire drawing so as to form the wire rod into any one of the modified cross-sectional shapes shown in FIGS. 1 to 3, and strand annealing is applied to obtain a steel wire. It is preferable to set the drawing reduction ratio of the wire rod of the wire drawing to be in a range of 10 to 95% as described above. Furthermore, as described above, it is preferable to set the annealing temperature of the strand annealing to be in a range of 900 to 1200° C. It is preferable to set the annealing time to be in a range of 5 seconds to 24 hours.

In the method for manufacturing the steel wire coil according to this embodiment, after the strand annealing is applied, the steel wire is passed through the pinch roll, and is coiled. In this embodiment, at the time of passing the steel wire pass through the pinch roll, the steel wire is passed through while the steel wire is flanked by the pinch roll in a manner such that the first straight portion of the first side and the second straight portion of the second side are brought into contact with each of the paired rolls disposed in the pinch roll so as to face each other. Then, with the pinch roll, the steel wire is conveyed to and coiled around the cylindrical drum while the conveying direction is being controlled so as to be a direction in which the external surface of the cylindrical drum around which the steel wire is coiled and the first straight portion or the second straight portion of the steel wire face each other. With this configuration, according to the method for manufacturing the steel wire coil of this embodiment, it is possible to prevent the crushing of the cross-sectional shape of the steel wire or the occurrence of defects in the steel wire during manufacturing.

It should be noted that, in the method for manufacturing the steel wire coil according to this embodiment, skin passing may be applied before the steel wire, which has been subjected to strand annealing, is passed through the pinch roll, in order to correct the cross-sectional shape or introduce dislocations.

It should be noted that, in the case where the cross-sectional shape of the steel wire according to this embodiment is a circle, it is less likely that the crushing of the cross-sectional shape of the steel wire or the occurrence of defects in the steel wire during manufacturing becomes a problem. Thus, in the case where the cross-sectional shape of the steel wire according to this embodiment is a circle, the steel wire may be coiled using any conventionally known method to obtain the steel wire coil.

EXAMPLES

Below, examples of this embodiment will be described.

Tables 1 to 3 show component compositions of wire rods according to the present example.

TABLE 1

(mass %)

| Section | Steel component | C | Si | Mn | P | S | Ni | Cr | Mo | Cu | Al | N | Others | C + N | Md30 |
|---|---|---|---|---|---|---|---|---|---|---|---|---|---|---|---|
| Inventive Steel | A | 0.020 | 0.4 | 15.5 | 0.03 | 0.002 | 9.6 | 18.2 | 0.0 | 3.1 | 0.02 | 0.030 | — | 0.05 | −170 |
| | B | 0.070 | 0.4 | 14.5 | 0.02 | 0.001 | 9.7 | 17.4 | 0.0 | 3.1 | 0.01 | 0.020 | — | 0.09 | −170 |
| | C | 0.020 | 0.3 | 13.5 | 0.02 | 0.001 | 9.9 | 17.4 | 0.0 | 3.2 | 0.03 | 0.080 | — | 0.10 | −171 |
| | D | 0.010 | 0.3 | 15.1 | 0.03 | 0.001 | 9.5 | 17.8 | 0.0 | 3.1 | 0.005 | 0.170 | — | 0.18 | −219 |
| | E | 0.020 | 0.1 | 14.8 | 0.02 | 0.003 | 9.9 | 18.6 | 0.0 | 3.1 | 0.02 | 0.030 | — | 0.05 | −170 |
| | F | 0.010 | 1.1 | 17.0 | 0.01 | 0.001 | 9.2 | 18.5 | 0.0 | 3.2 | 0.03 | 0.020 | — | 0.03 | −182 |
| | G | 0.030 | 0.3 | 8.2 | 0.02 | 0.002 | 9.9 | 18.6 | 0.0 | 3.2 | 0.02 | 0.090 | — | 0.12 | −153 |
| | H | 0.030 | 0.3 | 14.1 | 0.02 | 0.002 | 9.9 | 17.6 | 0.0 | 3.3 | 0.03 | 0.050 | — | 0.08 | −172 |
| | I | 0.020 | 0.3 | 24.9 | 0.02 | 0.002 | 9.5 | 17.5 | 0.0 | 3.2 | 0.03 | 0.090 | — | 0.11 | −265 |
| | J | 0.020 | 0.3 | 14.9 | 0.05 | 0.002 | 9.2 | 18.3 | 0.0 | 3.1 | 0.03 | 0.050 | — | 0.07 | −171 |
| | K | 0.010 | 0.3 | 15.1 | 0.02 | 0.008 | 9.8 | 18.0 | 0.0 | 3.2 | 0.03 | 0.050 | — | 0.06 | −172 |
| | L | 0.020 | 0.2 | 15.9 | 0.02 | 0.002 | 6.4 | 17.8 | 0.0 | 3.5 | 0.03 | 0.080 | — | 0.10 | −170 |
| | M | 0.030 | 0.3 | 13.8 | 0.03 | 0.002 | 12.1 | 17.5 | 0.0 | 3.3 | 0.02 | 0.030 | — | 0.06 | −180 |
| | N | 0.010 | 0.3 | 15.2 | 0.02 | 0.003 | 20.2 | 18.1 | 0.0 | 3.4 | 0.002 | 0.020 | — | 0.03 | −265 |

TABLE 1-continued (mass %)

| Section | Steel component | C | Si | Mn | P | S | Ni | Cr | Mo | Cu | Al | N | Others | C + N | Md30 |
|---|---|---|---|---|---|---|---|---|---|---|---|---|---|---|---|
| | O | 0.010 | 0.4 | 14.5 | 0.02 | 0.001 | 28.1 | 16.5 | 0.0 | 3.5 | 0.01 | 0.020 | — | 0.03 | −316 |
| | P | 0.020 | 0.5 | 15.9 | 0.03 | 0.002 | 9.9 | 14.2 | 0.0 | 3.3 | 0.03 | 0.080 | — | 0.10 | −151 |
| | Q | 0.020 | 0.2 | 14.9 | 0.02 | 0.002 | 9.5 | 20.0 | 0.0 | 3.2 | 0.03 | 0.080 | — | 0.10 | −213 |
| | R | 0.020 | 0.3 | 13.1 | 0.02 | 0.002 | 9.5 | 24.1 | 0.0 | 3.5 | 0.05 | 0.080 | — | 0.10 | −264 |
| | S | 0.020 | 0.3 | 19.7 | 0.02 | 0.003 | 9.5 | 18.2 | 0.0 | 0.5 | 0.03 | 0.090 | — | 0.11 | −154 |
| | T | 0.030 | 0.2 | 18.5 | 0.02 | 0.002 | 9.4 | 17.5 | 0.0 | 1.5 | 0.02 | 0.060 | — | 0.09 | −153 |
| | U | 0.020 | 0.3 | 15.9 | 0.02 | 0.002 | 8.9 | 17.5 | 0.0 | 2.8 | 0.01 | 0.040 | — | 0.06 | −152 |
| | V | 0.020 | 0.3 | 15.1 | 0.03 | 0.002 | 9.5 | 17.1 | 0.0 | 3.8 | 0.03 | 0.030 | — | 0.05 | −170 |
| | W | 0.010 | 0.3 | 15.9 | 0.02 | 0.001 | 9.3 | 18.1 | 0.0 | 3.5 | 0.5 | 0.020 | — | 0.03 | −170 |
| | X | 0.020 | 0.3 | 15.9 | 0.02 | 0.002 | 9.5 | 18.2 | 0.0 | 3.6 | 1.3 | 0.030 | — | 0.05 | −186 |
| | Y | 0.010 | 0.4 | 15.8 | 0.04 | 0.002 | 9.5 | 18.0 | 0.2 | 3.3 | 0.05 | 0.030 | — | 0.04 | −173 |
| | Z | 0.010 | 0.3 | 15.3 | 0.03 | 0.001 | 9.0 | 17.0 | 2.1 | 3.2 | 0.06 | 0.040 | — | 0.05 | −187 |

TABLE 2

(mass %)

| Section | Steel component | C | Si | Mn | P | S | Ni | Cr | Mo | Cu | Al | N | Others | C + N | Md30 |
|---|---|---|---|---|---|---|---|---|---|---|---|---|---|---|---|
| Inventive Steel | BA | 0.020 | 0.3 | 15.9 | 0.02 | 0.002 | 9.8 | 17.5 | 0.0 | 3.1 | 0.05 | 0.050 | Nb: 0.1 | 0.07 | −174 |
| | BB | 0.020 | 0.3 | 15.8 | 0.02 | 0.001 | 9.7 | 17.4 | 1.5 | 3.1 | 0.05 | 0.040 | Nb: 0.05, V: 0.2 | 0.06 | −194 |
| | BC | 0.010 | 0.3 | 15.1 | 0.02 | 0.002 | 9.3 | 17.9 | 0.0 | 3.1 | 0.05 | 0.050 | V: 0.2 | 0.06 | −163 |
| | BD | 0.020 | 0.4 | 14.8 | 0.02 | 0.003 | 9.4 | 18.0 | 1.5 | 3.1 | 0.05 | 0.030 | V: 0.15 | 0.05 | −187 |
| | BE | 0.010 | 0.3 | 15.8 | 0.02 | 0.002 | 9.4 | 18.1 | 0.0 | 3.1 | 0.04 | 0.050 | Ti: 0.2 | 0.06 | −173 |
| | BF | 0.020 | 0.5 | 15.8 | 0.02 | 0.001 | 9.2 | 18.1 | 0.0 | 3.3 | 0.04 | 0.030 | W: 0.2 | 0.05 | −174 |
| | BG | 0.030 | 0.3 | 15.5 | 0.03 | 0.002 | 9.1 | 18.2 | 0.0 | 3.3 | 0.04 | 0.020 | Ta: 0.2 | 0.05 | −170 |
| | BH | 0.010 | 0.3 | 16.5 | 0.02 | 0.001 | 9.0 | 18.1 | 0.0 | 3.1 | 0.03 | 0.040 | Co: 0.5 | 0.05 | −170 |
| | BI | 0.020 | 0.3 | 15.7 | 0.02 | 0.002 | 9.3 | 17.8 | 0.0 | 3.3 | 0.05 | 0.040 | B: 0.003 | 0.06 | −173 |
| | BJ | 0.010 | 0.3 | 14.7 | 0.02 | 0.002 | 9.5 | 17.9 | 1.1 | 3.3 | 0.05 | 0.040 | B: 0.002, Ca: 0.001 | 0.05 | −183 |
| | BK | 0.030 | 0.2 | 15.7 | 0.03 | 0.003 | 8.8 | 18.1 | 0.0 | 3.1 | 0.06 | 0.040 | Ca: 0.003 | 0.07 | −170 |
| | BL | 0.020 | 0.2 | 14.7 | 0.03 | 0.003 | 8.9 | 18.1 | 1.3 | 3.2 | 0.06 | 0.040 | Ca: 0.002 | 0.06 | −185 |
| | BM | 0.020 | 0.3 | 15.5 | 0.02 | 0.002 | 9.6 | 17.8 | 0.0 | 3.2 | 0.08 | 0.040 | Mg: 0.002 | 0.06 | −171 |
| | BN | 0.010 | 0.3 | 14.5 | 0.02 | 0.001 | 9.8 | 18.3 | 0.0 | 3.3 | 0.1 | 0.040 | REM: 0.01 | 0.05 | −170 |
| | BO | 0.010 | 0.3 | 14.5 | 0.02 | 0.001 | 9.9 | 18.4 | 0.0 | 3.3 | 0.1 | 0.040 | Nb: 0.05, V: 0.2 | 0.05 | −172 |
| | BP | 0.010 | 0.3 | 15.5 | 0.02 | 0.001 | 9.7 | 18.1 | 0.0 | 3.2 | 0.1 | 0.050 | B: 0.002, Ca: 0.001 | 0.06 | −176 |
| | BQ | 0.010 | 0.3 | 15.1 | 0.03 | 0.001 | 9.5 | 17.8 | 0.0 | 3.2 | 0.1 | 0.050 | B: 0.003, Ca: 0.002 | 0.06 | −167 |
| | BR | 0.020 | 0.4 | 15.1 | 0.03 | 0.002 | 9.5 | 17.9 | 0.0 | 3.3 | 0.1 | 0.050 | V: 0.1, B: 0.003 | 0.07 | −177 |
| | BS | 0.010 | 0.3 | 14.6 | 0.02 | 0.002 | 9.6 | 18.4 | 0.0 | 3.3 | 0.1 | 0.040 | Nb: 0.1, B: 0.003 | 0.05 | −170 |
| | BT | 0.010 | 0.3 | 14.6 | 0.02 | 0.001 | 9.8 | 18.5 | 0.0 | 3.3 | 0.1 | 0.040 | Nb: 0.2, V: 0.1, B: 0.002 | 0.05 | −173 |
| | CW | 0.010 | 0.3 | 9.9 | 0.02 | 0.001 | 19.5 | 20.0 | 0.0 | 2.0 | 0.01 | 0.020 | — | 0.03 | −201 |
| | CX | 0.020 | 0.3 | 9.9 | 0.02 | 0.001 | 15.1 | 20.0 | 0.0 | 2.0 | 0.01 | 0.040 | — | 0.06 | −173 |
| | CY | 0.005 | 0.3 | 9.5 | 0.02 | 0.001 | 23.0 | 19.0 | 0.0 | 1.0 | 0.03 | 0.030 | — | 0.04 | −191 |
| | CZ | 0.010 | 0.3 | 9.8 | 0.02 | 0.001 | 25.0 | 20.0 | 0.0 | 0.5 | 0.1 | 0.006 | — | 0.02 | −203 |
| | DA | 0.020 | 0.4 | 9.5 | 0.02 | 0.002 | 20.0 | 19.0 | 0.5 | 1.9 | 0.03 | 0.030 | — | 0.05 | −205 |
| | DB | 0.030 | 0.4 | 9.6 | 0.02 | 0.001 | 20.0 | 20.0 | 0.0 | 1.8 | 0.05 | 0.007 | B: 0.002 | 0.04 | −202 |
| | DC | 0.004 | 0.4 | 9.6 | 0.02 | 0.001 | 21.0 | 19.0 | 0.0 | 1.7 | 0.04 | 0.020 | Nb: 0.06 | 0.02 | −189 |
| | DD | 0.010 | 0.4 | 9.7 | 0.02 | 0.001 | 20.8 | 19.0 | 0.0 | 1.6 | 0.04 | 0.030 | Ca: 0.003 | 0.04 | −192 |
| | DE | 0.030 | 0.3 | 16.9 | 0.03 | 0.002 | 9.8 | 19.3 | 0.8 | 1.9 | 0.04 | 0.020 | Co: 0.3 | 0.05 | −177 |
| | DF | 0.020 | 0.4 | 16.9 | 0.01 | 0.001 | 9.9 | 19.9 | 0.0 | 1.8 | 0.04 | 0.030 | Co: 0.7, V: 0.1 | 0.05 | −169 |
| | DG | 0.020 | 0.3 | 16.8 | 0.02 | 0.001 | 9.5 | 20.5 | 0.0 | 1.9 | 0.04 | 0.010 | Co: 1.1, B: 0.003 | 0.03 | −169 |
| | DH | 0.030 | 0.4 | 16.9 | 0.02 | 0.001 | 9.5 | 20.2 | 0.0 | 1.9 | 0.04 | 0.020 | Co: 0.3, Ca: 0.003 | 0.05 | −173 |

TABLE 3

(mass %)

| Section | Steel component | C | Si | Mn | P | S | Ni | Cr | Mo | Cu | Al | N | Others | C + N | Md30 |
|---|---|---|---|---|---|---|---|---|---|---|---|---|---|---|---|
| Comparative steel | BU | 0.090 | 0.3 | 14.8 | 0.02 | 0.002 | 9.0 | 18.0 | 0.0 | 3.3 | 0.03 | 0.020 | — | 0.11 | −188 |
| | BV | 0.010 | 2.5 | 13.8 | 0.01 | 0.002 | 9.4 | 17.0 | 0.0 | 2.9 | 0.05 | 0.080 | — | 0.09 | −170 |
| | BW | 0.050 | 0.3 | 7.3 | 0.02 | 0.001 | 14.5 | 17.3 | 0.0 | 2.5 | 0.06 | 0.080 | — | 0.13 | −156 |
| | BX | 0.010 | 0.3 | 26.5 | 0.02 | 0.002 | 9.3 | 18.2 | 0.0 | 3.4 | 0.07 | 0.020 | — | 0.03 | −255 |
| | BY | 0.010 | 0.3 | 15.1 | 0.07 | 0.002 | 9.2 | 18.5 | 0.0 | 3.3 | 0.08 | 0.040 | — | 0.05 | −172 |
| | BZ | 0.020 | 0.2 | 15.5 | 0.02 | 0.015 | 9.8 | 18.6 | 0.0 | 2.5 | 0.09 | 0.060 | — | 0.08 | −172 |
| | CA | 0.010 | 0.3 | 18.5 | 0.02 | 0.002 | 5.6 | 19.0 | 0.0 | 2.9 | 0.02 | 0.060 | — | 0.07 | −170 |
| | CB | 0.010 | 0.3 | 15.9 | 0.03 | 0.002 | 33.0 | 18.5 | 0.0 | 2.5 | 0.03 | 0.020 | — | 0.03 | −372 |

TABLE 3-continued (mass %)

| Section | Steel component | C | Si | Mn | P | S | Ni | Cr | Mo | Cu | Al | N | Others | C + N | Md30 |
|---|---|---|---|---|---|---|---|---|---|---|---|---|---|---|---|
| | CC | 0.030 | 0.3 | 20.1 | 0.02 | 0.002 | 9.5 | 12.8 | 0.0 | 2.4 | 0.03 | 0.050 | — | 0.08 | −125 |
| | CD | 0.030 | 0.4 | 14.6 | 0.02 | 0.002 | 9.5 | 14.5 | 0.0 | 3.3 | 0.03 | 0.050 | — | 0.08 | −131 |
| | CE | 0.010 | 0.2 | 13.9 | 0.02 | 0.001 | 9.4 | 26.3 | 0.0 | 2.9 | 0.03 | 0.050 | — | 0.06 | −263 |
| | CF | 0.020 | 0.4 | 18.5 | 0.02 | 0.003 | 9.9 | 18.7 | 0.0 | 0.1 | 0.02 | 0.150 | — | 0.17 | −172 |
| | CG | 0.010 | 0.4 | 14.2 | 0.03 | 0.002 | 9.2 | 18.4 | 0.0 | 5.1 | 0.01 | 0.040 | — | 0.05 | −216 |
| | CH | 0.020 | 0.5 | 15.6 | 0.03 | 0.003 | 9.5 | 17.5 | 0.0 | 3.1 | 0 | 0.080 | — | 0.10 | −184 |
| | CI | 0.010 | 0.3 | 15.9 | 0.02 | 0.002 | 9.5 | 17.5 | 0.0 | 3.3 | 1.7 | 0.050 | — | 0.06 | −172 |
| | CJ | 0.030 | 0.3 | 14.0 | 0.02 | 0.004 | 8.9 | 18.5 | 0.0 | 3.4 | 0.07 | 0.230 | — | 0.26 | −260 |
| | CK | 0.060 | 0.3 | 14.2 | 0.02 | 0.004 | 9.1 | 18.4 | 0.0 | 3.3 | 0.05 | 0.170 | — | 0.23 | −245 |
| | CL | 0.010 | 0.3 | 13.8 | 0.03 | 0.002 | 9.0 | 17.5 | 3.5 | 3.2 | 0.08 | 0.020 | — | 0.03 | −198 |
| | CM | 0.010 | 0.5 | 15.8 | 0.02 | 0.002 | 9.8 | 17.4 | 0.0 | 3.1 | 0.1 | 0.060 | Nb: 1.2 | 0.07 | −173 |
| | CN | 0.020 | 0.3 | 15.9 | 0.02 | 0.002 | 8.8 | 18.4 | 0.0 | 3.1 | 0.05 | 0.060 | V: 1.3 | 0.08 | −181 |
| | CO | 0.010 | 0.3 | 15.8 | 0.02 | 0.002 | 9.0 | 18.6 | 0.0 | 3.1 | 0.04 | 0.040 | Ti: 1.2 | 0.05 | −171 |
| | CP | 0.010 | 0.3 | 14.8 | 0.03 | 0.003 | 9.6 | 18.3 | 0.0 | 3.1 | 0.03 | 0.060 | W: 1.3 | 0.07 | −174 |
| | CQ | 0.010 | 0.2 | 15.2 | 0.02 | 0.002 | 9.8 | 18.4 | 0.0 | 3.1 | 0.05 | 0.040 | Ta: 1.1 | 0.05 | −170 |
| | CR | 0.020 | 0.3 | 15.5 | 0.02 | 0.002 | 9.3 | 18.5 | 0.0 | 3.3 | 0.05 | 0.040 | Co: 3.5 | 0.06 | −181 |
| | CS | 0.020 | 0.4 | 15.8 | 0.04 | 0.001 | 9.6 | 18.4 | 0.0 | 3.1 | 0.04 | 0.040 | B: 0.018 | 0.06 | −180 |
| | CT | 0.020 | 0.3 | 15.7 | 0.02 | 0.002 | 9.6 | 17.8 | 0.0 | 3.1 | 0.04 | 0.040 | Ca: 0.013 | 0.06 | −170 |
| | CU | 0.020 | 0.3 | 15.7 | 0.02 | 0.003 | 9.4 | 17.9 | 0.0 | 3.1 | 0.05 | 0.050 | Mg: 0.011 | 0.07 | −174 |
| | CV | 0.010 | 0.3 | 15.9 | 0.02 | 0.002 | 9.1 | 18.1 | 0.0 | 3.2 | 0.04 | 0.050 | REM: 0.06 | 0.06 | −173 |

*Underlined values are outside the ranges according to the present invention.

On the assumption that an argon oxygen decarburization (AOD) smelting process, which is an inexpensive smelting process for stainless steel, is used, 100 kg of steel was melted with a vacuum smelting furnace, and the steel was cast into a cast steel having a diameter of 180 mm and the component composition shown in Tables 1 to 3. The cast steel thus obtained was subjected to hot wire-rod rolling (area reduction ratio: 99.9%) so as to have a diameter of 6 mm, and then, the hot rolling was completed at 1000° C. Thereafter, the cast steel was maintained at 1050° C. for 30 minutes, and then, cooling was performed, which served as a solution heat treatment (homogenizing thermal treatment). Furthermore, acid pickling was applied, and a wire rod having a circular shape when viewed in cross section was obtained.

Furthermore, some of the wire rods were subjected to wire drawing with an ordinary manufacturing process for steel wire to obtain a steel wire having a circular shape with a diameter of 4.2 mm when viewed in cross section, and strand annealing of maintaining the steel wire at 1050° C. for three minutes was applied; and thereby, the steel wire was obtained.

Then, a tensile strength, a reduction of an area at tensile rupture, cold workability, corrosion resistance, and magnetic properties of the wire rod and the steel wire thus obtained were evaluated. The evaluation results are shown in Tables 4 to 6. Note that, in the results of each property shown in Tables 4 to 6, the results of Nos. 1, 3, 5 to 76, 82 to 89, and 116 to 119 are the measured characteristic values of the wire rods, and the results of Nos. 2 and 4 are the measured characteristic values of the steel wires.

TABLE 4

| No. | Section | Steel composition | Wire rod/ Steel wire | Tensile strength (MPa) | Reduction of area at tensile rupture (%) | Cold workability | Corrosion resistance | Magnetic flux density (T) |
|---|---|---|---|---|---|---|---|---|
| 1 | Inventive | A | Wire rod | 560 | 80 | A | B | 0.005 |
| 2 | Example | | Steel wire | 570 | 80 | A | B | 0.004 |
| 3 | | B | Wire rod | 590 | 80 | A | B | 0.006 |
| 4 | | | Steel wire | 590 | 80 | A | B | 0.005 |
| 5 | | C | Wire rod | 590 | 80 | A | B | 0.004 |
| 6 | | D | Wire rod | 620 | 75 | B | B | 0.003 |
| 7 | | E | Wire rod | 550 | 80 | A | B | 0.002 |
| 8 | | F | Wire rod | 550 | 80 | A | B | 0.006 |
| 9 | | G | Wire rod | 600 | 75 | B | B | 0.008 |
| 10 | | H | Wire rod | 560 | 80 | A | B | 0.005 |
| 11 | | I | Wire rod | 640 | 75 | B | B | 0.004 |
| 12 | | J | Wire rod | 550 | 75 | A | B | 0.006 |
| 13 | | K | Wire rod | 570 | 80 | A | B | 0.003 |
| 14 | | L | Wire rod | 570 | 80 | A | B | 0.002 |
| 15 | | M | Wire rod | 570 | 80 | A | B | 0.008 |
| 16 | | N | Wire rod | 600 | 75 | B | B | 0.008 |
| 17 | | O | Wire rod | 530 | 75 | A | B | 0.009 |
| 18 | | P | Wire rod | 510 | 80 | A | B | 0.008 |
| 19 | | Q | Wire rod | 580 | 80 | A | B | 0.003 |
| 20 | | R | Wire rod | 580 | 80 | A | B | 0.006 |
| 21 | | S | Wire rod | 630 | 75 | B | B | 0.009 |
| 22 | | T | Wire rod | 580 | 80 | A | B | 0.008 |
| 23 | | U | Wire rod | 570 | 80 | A | B | 0.008 |
| 24 | | V | Wire rod | 530 | 80 | A | B | 0.004 |
| 25 | | W | Wire rod | 550 | 75 | A | B | 0.005 |
| 26 | | X | Wire rod | 560 | 80 | A | B | 0.005 |

TABLE 4-continued

| No. | Section | Steel composition | Wire rod/ Steel wire | Tensile strength (MPa) | Reduction of area at tensile rupture (%) | Cold workability | Corrosion resistance | Magnetic flux density (T) |
|---|---|---|---|---|---|---|---|---|
| 27 | | Y | Wire rod | 550 | 80 | A | B | 0.006 |
| 28 | | Z | Wire rod | 530 | 80 | A | B | 0.005 |
| 29 | | BA | Wire rod | 550 | 80 | A | B | 0.006 |
| 30 | | BB | Wire rod | 540 | 80 | A | B | 0.005 |
| 31 | | BC | Wire rod | 580 | 80 | A | B | 0.009 |
| 32 | | BD | Wire rod | 570 | 80 | A | B | 0.007 |
| 33 | | BE | Wire rod | 560 | 80 | A | B | 0.005 |
| 34 | | BF | Wire rod | 540 | 75 | A | B | 0.006 |
| 35 | | BG | Wire rod | 550 | 80 | A | B | 0.006 |
| 36 | | BH | Wire rod | 540 | 80 | A | B | 0.006 |
| 37 | | BI | Wire rod | 560 | 80 | A | B | 0.005 |
| 38 | | BJ | Wire rod | 550 | 80 | A | B | 0.004 |
| 39 | | BK | Wire rod | 560 | 80 | A | B | 0.005 |
| 40 | | BL | Wire rod | 550 | 80 | A | B | 0.006 |
| 41 | | BM | Wire rod | 550 | 80 | A | B | 0.006 |
| 42 | | BN | Wire rod | 540 | 80 | A | B | 0.005 |
| 43 | | BO | Wire rod | 540 | 80 | A | B | 0.004 |
| 44 | | BP | Wire rod | 550 | 80 | A | B | 0.004 |
| 45 | | BQ | Wire rod | 540 | 80 | A | B | 0.004 |
| 46 | | BR | Wire rod | 560 | 80 | A | B | 0.005 |
| 47 | | BS | Wire rod | 550 | 80 | A | B | 0.005 |
| 48 | | BT | Wire rod | 540 | 80 | A | B | 0.005 |

TABLE 5

| No. | Section | Steel composition | Wire rod/ Steel wire | Tensile strength (MPa) | Reduction of area at tensile rupture (%) | Cold workability | Corrosion resistance | Magnetic flux density (T) |
|---|---|---|---|---|---|---|---|---|
| 82 | Inventive | CW | Wire rod | 600 | 70 | B | B | 0.008 |
| 83 | Example | CX | Wire rod | 610 | 70 | B | B | 0.008 |
| 84 | | CY | Wire rod | 600 | 70 | B | B | 0.008 |
| 85 | | CZ | Wire rod | 620 | 70 | B | B | 0.010 |
| 86 | | DA | Wire rod | 600 | 70 | B | B | 0.008 |
| 87 | | DB | Wire rod | 620 | 70 | B | B | 0.009 |
| 88 | | DC | Wire rod | 620 | 70 | B | B | 0.008 |
| 89 | | DD | Wire rod | 610 | 70 | B | B | 0.008 |
| 116 | | DE | Wire rod | 540 | 80 | A | B | 0.006 |
| 117 | | DF | Wire rod | 550 | 80 | A | B | 0.006 |
| 118 | | DG | Wire rod | 530 | 80 | A | B | 0.006 |
| 119 | | DH | Wire rod | 550 | 80 | A | B | 0.006 |

TABLE 6

| No. | Section | Steel composition | Wire rod/ Steel wire | Tensile strength (MPa) | Reduction of area at tensile rupture (%) | Cold workability | Corrosion resistance | Magnetic flux density (T) |
|---|---|---|---|---|---|---|---|---|
| 49 | Comparative | BU | Wire rod | 660 | 70 | C | B | 0.006 |
| 50 | example | BV | Wire rod | 660 | 70 | C | B | 0.007 |
| 51 | | BW | Wire rod | 630 | 75 | A | B | 0.030 |
| 52 | | BX | Wire rod | 660 | 80 | C | B | 0.005 |
| 53 | | BY | Wire rod | 540 | 60 | C | B | 0.006 |
| 54 | | BZ | Wire rod | 600 | 65 | C | C | 0.005 |
| 55 | | CA | Wire rod | 600 | 75 | B | B | 0.020 |
| 56 | | CB | Wire rod | 600 | 75 | B | B | 0.014 |
| 57 | | CC | Wire rod | 600 | 75 | B | C | 0.250 |
| 58 | | CD | Wire rod | 620 | 75 | B | B | 0.240 |
| 59 | | CE | Wire rod | 660 | 70 | C | B | 0.100 |
| 60 | | CF | Wire rod | 670 | 70 | C | B | 0.020 |
| 61 | | CG | Wire rod | Could not be manufactured. | | | | |
| 62 | | CH | Wire rod | 660 | 65 | C | B | 0.007 |
| 63 | | CI | Wire rod | 540 | 65 | C | B | 0.005 |
| 64 | | CJ | Wire rod | 760 | 65 | C | B | 0.006 |
| 65 | | CK | Wire rod | 740 | 65 | C | B | 0.006 |
| 66 | | CL | Wire rod | 670 | 70 | C | B | 0.006 |
| 67 | | CM | Wire rod | 560 | 65 | C | B | 0.005 |

TABLE 6-continued

| No. | Section | Steel composition | Wire rod/ Steel wire | Tensile strength (MPa) | Reduction of area at tensile rupture (%) | Cold workability | Corrosion resistance | Magnetic flux density (T) |
|---|---|---|---|---|---|---|---|---|
| 68 | | CN | Wire rod | 590 | 65 | C | B | 0.006 |
| 69 | | CO | Wire rod | 550 | 60 | C | B | 0.006 |
| 70 | | CP | Wire rod | 580 | 65 | C | B | 0.006 |
| 71 | | CQ | Wire rod | 550 | 60 | C | B | 0.006 |
| 72 | | CR | Wire rod | 650 | 65 | C | B | 0.006 |
| 73 | | CS | Wire rod | 560 | 65 | C | B | 0.005 |
| 74 | | CT | Wire rod | 550 | 60 | C | B | 0.005 |
| 75 | | CU | Wire rod | 560 | 60 | C | B | 0.005 |
| 76 | | CV | Wire rod | 540 | 60 | C | B | 0.006 |

*Underlined values are outside the ranges according to the present invention.

The tensile strength and the reduction of an area at tensile rupture of the wire rod and the steel wire were measured according to JIS Z 2241.

With regard to all the Inventive Examples, the tensile strength was 650 MPa or less, and the reduction of an area at tensile rupture was 70% or more.

Furthermore, with regard to all the Inventive Examples having optimized component compositions containing Mn: more than 13.0% to 20% or less, Cu: 1.0% to 4.0%. Al: 0.01% to 1.3%, and N: 0.01 or more to less than 0.10%, the tensile strength was 590 MPa or less, and the reduction of an area at tensile rupture was 75% or more, which were favorable values.

Evaluation of cold workability was made by cutting out cylindrical samples having a diameter of 4 mm and a height of 6 mm from the wire rod or the steel wire, and applying cold compressing work (strain rate: 10/s) at a working ratio of 75% in a height direction so as to form the wire rod or the steel wire into a flat disc shape. Then, whether cracks existed or not was confirmed in samples after the compressing work, and deformation resistance at the time of the compressing work was measured.

Cold workability was evaluated as B (good) in the case where no crack occurred and the cold compressing work could be performed with deformation resistance of smaller than the deformation resistance (1100 MPa) of SUS304, whereas cold workability was evaluated as C (bad) in the case where crack occurred or the deformation resistance was equal to or greater than that of SUS304. Furthermore, cold workability was evaluated as A (excellent) in the case where deformation resistance was equivalent to SUSXM7 (1000 MPa or less).

Inventive Examples were evaluated as B (good) and A (excellent), and excellent cold workability was exhibited.

Evaluation of corrosion resistance was made according to the salt spray testing of JIS Z 2371, by performing a spraying test for 100 hours, and judging whether rust occurred or not. Corrosion resistance was evaluated as favorable (B) in the case of non-rust level, whereas corrosion resistance was evaluated as bad (C) in the case where red rust such as flowing rust and the like occurred.

All the Inventive Examples were evaluated as favorable.

Evaluation of magnetic property was made on the basis of a magnetic flux density when applying a magnetic field of 10000 (Oe) to samples after the cold compressing work used in the evaluation of cold workability with a DC-magnetization test device.

With regard to the Inventive Examples, the magnetic flux density was 0.01 T or less even though it was after the cold compressing work. In particular, by optimizing the component composition to fulfill Mn: more than 13.0% to 24.9% or less, Ni: more than 6.0% to less than 10.0%, and Md30: −167 or less, these examples exhibited 0.007 T or less, which is a favorable super non-magnetic property.

Next, examination was carried out about effects of the hot working ratio of hot wire-rod rolling and the temperature of a homogenizing thermal treatment applied thereafter, on local segregation of Ni or Cu.

Cast steels each having a diameter of 180 mm were prepared, which were made of steels A and CW having the component compositions shown in Table 1 or 2 in a manner similar to the processes for manufacturing the wire rods shown in Table 4 or 5. These cast steels were subjected to hot wire-rod rolling at area reduction ratios shown in Table 7 so as to have a diameter of 6 mm (area reduction ratio: 99.9%), a diameter of 18 mm (area reduction ratio: 99.0%), or a diameter of 30 mm (area reduction ratio: 97.0%). Then, the hot rolling was completed at 1000° C. Thereafter, a solution heat treatment (homogenizing thermal treatment) was applied, in which steels were maintained at 900° C. for 30 minutes in Nos. 80 and 94 in Table 7, steels were maintained at 1050° C. for 30 minutes in Nos. 77, 81, 90, 95, 97, and 99 in Table 7, steels were maintained at 1150° C. for 30 minutes in Nos. 78, 91, 92, 96, and 98 in Table 7, and steels were maintained at 1250° C. for 30 minutes in Nos. 79 and 93 in Table 7; then, water cooling was applied; and acid pickling was applied, thereby, wire rods each having a circular shape when viewed in cross section were obtained. Furthermore, through general manufacturing processes for a steel wire, some of the wire rods were subjected to wire drawing to obtain steel wires having a circular shape with a diameter of 4.2 mm when viewed in cross section, and strand annealing of maintaining the steel wires at 1050° C. for three minutes was applied; and thereby, steel wires (No. 96 to 99 in Table 7) were obtained.

Then, a tensile strength, a reduction of an area at tensile rupture, cold workability, corrosion resistance, and magnetic properties of the wire rods and the steel wires thus obtained were evaluated in a manner similar to that described above. In addition, the standard deviation of the segregation of Ni and Cu in the steel materials and the steel wires was calculated using the following method. The results are shown in Table 7. Note that, in the respective results shown in Table 7, the results of Nos. 77 to 81 and 90 to 95 are the measured characteristic values of the wire rods, and the results of Nos. 96 to 99 are the measured characteristic values of the steel wires. The respective characteristic values of the steel wires were measured in a manner similar to that for the wire rod described above.

TABLE 7

| No. | Section | Steel composition | Area reduction ratio of wire-rod rolling (%) | Temperature for homogenizing thermal treatment (° C.) | Tensile strength (MPa) | Reduction of area at tensile rupture (%) | Cold workability |
|---|---|---|---|---|---|---|---|
| 77 | Inventive | A | 99.9 | 1050 | 560 | 80 | A |
| 78 | Example | | 99.9 | 1150 | 540 | 80 | A |
| 96 | | | 99.9 | 1150 | 540 | 80 | A |
| 79 | Comparative | | 99.9 | 1250 | 530 | 80 | A |
| 80 | example | | 99.9 | 900 | 660 | 65 | C |
| 81 | | | 97.0 | 1050 | 590 | 75 | A |
| 97 | | | 97.0 | 1050 | 590 | 75 | A |
| 90 | Inventive | CW | 99.9 | 1050 | 600 | 70 | B |
| 91 | Example | | 99.9 | 1150 | 600 | 70 | B |
| 92 | | | 99.0 | 1150 | 620 | 70 | B |
| 98 | | | 99.0 | 1150 | 610 | 70 | B |
| 93 | Comparative | | 99.9 | 1250 | 600 | 70 | B |
| 94 | example | | 99.9 | 900 | 660 | 65 | C |
| 95 | | | 97.0 | 1050 | 620 | 70 | B |
| 99 | | | 97.0 | 1050 | 620 | 70 | B |

| No. | Section | Steel composition | Corrosion resistance | Magnetic flux density (T) | Standard deviation of Ni concentration (mass %) | Standard deviation of Cu concentration (mass %) |
|---|---|---|---|---|---|---|
| 77 | Inventive | A | B | 0.005 | 2.3 | 0.8 |
| 78 | Example | | B | 0.006 | 2.2 | 0.9 |
| 96 | | | B | 0.005 | 2.1 | 0.8 |
| 79 | Comparative | | B | 0.030 | 5.1 | 1.8 |
| 80 | example | | B | 0.020 | 5.3 | 1.7 |
| 81 | | | B | 0.020 | 5.3 | 1.8 |
| 97 | | | B | 0.015 | 5.1 | 1.7 |
| 90 | Inventive | CW | B | 0.008 | 2.3 | 0.7 |
| 91 | Example | | B | 0.007 | 2.4 | 0.6 |
| 92 | | | B | 0.010 | 4.4 | 1.4 |
| 98 | | | B | 0.009 | 4.3 | 1.3 |
| 93 | Comparative | | B | 0.030 | 5.2 | 1.7 |
| 94 | example | | B | 0.015 | 5.3 | 1.6 |
| 95 | | | B | 0.014 | 5.5 | 1.6 |
| 99 | | | B | 0.012 | 5.3 | 1.6 |

*Underlined values are outside the ranges according to the present invention.

The standard deviations of the Ni concentration and the Cu concentration in the wire rod or the steel wire (standard deviation σ of variation in the central portion in the transverse cross section) were calculated in the following manner. At first, through EPMA analysis, map analysis was carried out in terms of concentration in an arbitrary portion of an area extending from the center of the wire rod or the steel wire in transverse cross section and surrounded by a circle having a radius of one quarter of the diameter of the wire rod or the steel wire, and then, evaluation was made. During the EPMA analysis, the Ni concentration and the Cu concentration were measured at measurement portions in a lattice form with 200 points in height and 200 points in width at 1 μm pitch, and the standard deviations σ of the variations of the Ni concentration and the Cu concentration were obtained.

As shown in Table 7, with regard to Inventive Examples in which the hot working ratio of the wire rod (area reduction ratio of hot wire-rod rolling) was set to 99% or more, and the temperature of the homogenizing thermal treatment was set to be in a range of 1000 to 1200° C., the standard deviation of the Ni segregation was 5% or less, the standard deviation of the Cu segregation was 1.5% or less, and favorable cold workability and super non-magnetic property were exhibited.

Next, examination was carried out about an effect of a modified cross-sectional shape of the steel wire on the crushing of the shape after the strand annealing, in order to obtain an annealed soft steel wire coil having a modified cross-sectional shape which is not crushed.

Cast steels each having a diameter of 180 mm were prepared, which were made of steels A and CW having the component compositions shown in Table 1 or 2 in a manner similar to the processes for manufacturing the wire rod shown in Table 4 or 5. These cast steels were subjected to hot wire-rod rolling at an area reduction ratio of 99.9% so as to have a diameter of 6 mm. Then, the hot rolling was completed at 1000° C. Thereafter, a solution heat treatment (homogenizing thermal treatment) was applied, in which steels were maintained at 1050° C. for 30 minutes; then, water cooling was applied; and acid pickling was applied, thereby, wire rods each having a circular shape when viewed in cross section.

The manufactured wire rods having a circular shape with a diameter of 6 mm when viewed in cross section were subjected to modified-shaped wire rolling (wire drawing) to form steel wires having a quadrangular modified cross-sectional shape shown in FIG. 1 and having each portion changed so as to have dimensions as shown in Table 8. Then, strand annealing of maintaining the steel wires at 1050° C. for three minutes was applied, and the steel wires were coiled using the method described below; and thereby, steel wire coils were obtained.

In Table 8, "T" represents the maximum dimension of the cross-sectional shape in a direction perpendicular to the first straight portion, and "W" represents the maximum dimension of the cross-sectional shape in a direction parallel to the first straight portion. "α" represents an angle formed by the first straight portion 1*a* and the second straight portion 2*a*. "L1" represents the length of the first side 1, and "L2" represents the length of the second side 2.

"Coiling Method"

The steel wires were flanked by the paired rolls disposed in the pinch roll so as to face each other and be in parallel to each other, in a manner such that the first straight portion 1*a* and the second straight portion 2*a* were brought into contact with each of the paired rolls, and the steel wires were passed through the pinch roll. Furthermore, the steel wires were coiled while the conveying direction of the steel wires were being controlled.

TABLE 8

| No. | Section | Steel composition | T (mm) | W (mm) | T/W | α (°) | L1 (mm) | L2 (mm) | Shape evaluation |
|---|---|---|---|---|---|---|---|---|---|
| 100 | Inventive | A | 2 | 3 | 0.6667 | 0 | 1.5 | 3 | A |
| 101 | Example | | 2 | 3 | 0.6667 | 10 | 2 | 3 | A |
| 102 | | | 2 | 3 | 0.6667 | 20 | 0.6 | 3 | B |
| 103 | | | 3 | 1.9 | 1.5789 | 10 | 1.7 | 1.9 | B |
| 104 | | | 3 | 3 | 1 | 0 | 0.4 | 3 | B |
| 105 | Comparative | | 4.2 | 1.3 | 3.231 | 0 | 0.9 | 1.3 | C |
| 106 | example | | 2 | 3 | 0.6667 | 35 | 2 | 3 | C |
| 107 | | | 2 | 3 | 0.6667 | 0 | 0.2 | 3 | C |
| 108 | Inventive | CW | 2.2 | 3.2 | 0.6875 | 0 | 1.5 | 3.2 | A |
| 109 | Example | | 2.2 | 3.2 | 0.6875 | 10 | 2 | 3.2 | A |
| 110 | | | 2.2 | 3.2 | 0.6875 | 25 | 0.7 | 3.2 | B |
| 111 | | | 3.2 | 1.9 | 1.6842 | 10 | 1.7 | 1.9 | B |
| 112 | | | 3 | 3 | 1 | 0 | 0.4 | 3 | B |
| 113 | Comparative | | 4.3 | 1.3 | 3.308 | 0 | 0.9 | 1.3 | C |
| 114 | example | | 2 | 3 | 0.6667 | 40 | 2 | 3 | C |
| 115 | | | 2 | 3 | 0.6667 | 0 | 0.2 | 3 | C |

*Underlined values are outside the ranges according to the present invention.

The steel wires in the steel wire coils were visually evaluated (evaluation as to shape) as to whether there existed any crushed cross-sectional shape, and whether there existed any defects. The steel wires in which crushing and defects existed were evaluated as C (bad), the steel wires in which no crushing existed were evaluated as B (good), the steel wires in which neither cursing nor defects existed were evaluated as A (excellent). The evaluation results are shown in Table 8.

As shown in Table 8, if any one of T/W, α, and L1 was outside the range of this embodiment, crushing and defects occurred in the steel wire in the steel wire coil, and the shape evaluation resulted in C (bad).

From Table 8, it is understood that it is possible to prevent the crushing of the cross-sectional shape of the steel wire or the occurrence of defects in the steel wire, by forming the cross-sectional shape of the steel wire in the steel wire coil, into a modified cross-sectional shape in which a is 30° or less, T/W is 3 or less, and each of L1 and L2 falls within a range of W/10 to W.

INDUSTRIAL APPLICABILITY

As can be clearly understood from each of the examples described above, according to this embodiment, it is possible to manufacture, at low cost, an austenitic stainless-steel wire rod and a steel wire that exhibit excellent cold workability, and have high corrosion resistance and the super non-magnetic property. With the wire rod, the steel wire, and the steel wire coil into which the steel wire having a modified cross-sectional shape is coiled according to this embodiment, it is possible to perform cold working to obtain a complicated shape, and it is possible to impart the super non-magnetic property to a product after cold working.

Therefore, this embodiment can provide a product having high corrosion resistance and super non-magnetic property at low cost, and is extremely industrially useful.

BRIEF DESCRIPTION OF THE REFERENCE SYMBOLS

1, 1B, 1C: first side, 1*a*, 11*a*: first straight portion, 2, 2B, 2C: second side, and 2*a*, 12*a*: second straight portion.

The invention claimed is:

1. A super non-magnetic soft stainless-steel wire coil having excellent cold workability and excellent corrosion resistance, the coil comprising a steel wire in a coiled state, wherein:

a cross-sectional shape of the steel wire comprises:

a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, a length of the first side is equal to or longer than a length of the second side, and the length of the first side and the length of the second side relative to the second dimension (W) each fall within a range of W/10 to W, the steel wire is a super non-magnetic soft stainless steel wire having a component composition comprising, in mass %:

C: 0.08% or less,

Si: 0.05% to 2.0%,

Mn: more than 8.0% to 25.0% or less,

P: 0.06% or less,

S: 0.01% or less,

Ni: more than 6.0% to 30.0% or less,

Cr: 13.0% to 25.0%,

Cu: 0.2% to 5.0%,

N: less than 0.20%,

Al: 0.002% to 1.5%, and

C+N: less than 0.20%, with the remainder being Fe and inevitable impurities,

Md30, which is expressed as Equation (a) described below, is −150 or less, and in a central portion in a transverse cross section of the steel wire, a standard deviation σ of a variation of a Ni concentration is 5 mass % or less, and a standard deviation σ of a variation of a Cu concentration is 1.5 mass % or less, $$Md30=413-462(C+N)-9.2Si-8.1Mn-9.5Ni-13.7Cr-29Cu \quad (a),$$

where element symbols in Equation (a) mean the content (mass %) of each of the elements contained in steel.

2. A method for manufacturing a super non-magnetic soft stainless-steel wire coil having excellent cold workability and excellent corrosion resistance, the method comprising:

subjecting a wire rod to wire drawing to obtain a steel wire having a modified cross-sectional shape, in which the cross-sectional shape comprises: a first side having a first straight portion; and a second side having a second straight portion, which is parallel to the first straight portion and placed so as to face the first straight portion, or which is sloped at an angle of 30° or less relative to the first straight portion and placed so as to face the first straight portion, a ratio (T/W) of a first dimension (T), which is the maximum dimension of the cross-sectional shape in a direction perpendicular to the first straight portion, relative to a second dimension (W), which is the maximum dimension of the cross-sectional shape in a direction parallel to the first straight portion, is 3 or less, and a length of the first side is equal to or longer than a length of the second side, and the length of the first side and the length of the second side relative to the second dimension (W) each fall within a range of W/10 to W;

applying strand annealing; and then, flanking the steel wire by a pinch roll in a manner such that the first straight portion and the second straight portion are brought into contact with each of paired rolls disposed so as to face each other, passing the steel wire through the pinch roll, and coiling the steel wire, wherein the wire rod is a super non-magnetic soft stainless steel wire rod comprising, in mass %:

C: 0.08% or less,

Si: 0.05% to 2.0%,

Mn: more than 8.0% to 25.0% or less,

P: 0.06% or less,

S: 0.01% or less,

Ni: more than 6.0% to 30.0% or less,

Cr: 13.0% to 25.0%,

Cu: 0.2% to 5.0%,

N: less than 0.20%,

Al: 0.002% to 1.5%, and

C+N: less than 0.20%, with the remainder being Fe and inevitable impurities,

Md30, which is expressed as Equation (a) described below, is −150 or less, and in a central portion in a transverse cross section of the wire rod, a standard deviation a of a variation of a Ni concentration is 5 mass % or less, and a standard deviation a of a variation of a Cu concentration is 1.5 mass % or less, $$Md30=413-462(C+N)-9.2Si-8.1Mn-9.5Ni-13.7Cr-29Cu \quad (a),$$

where element symbols in Equation (a) mean the content (mass %) of each of the elements contained in steel.

3. The method for manufacturing a super non-magnetic soft stainless-steel wire coil according to claim 2, wherein a tensile strength of the wire rod is 650 MPa or less, and a reduction of an area at tensile rupture of the wire rod is 70% or more.

4. The super non-magnetic soft stainless-steel wire coil according to claim 1, wherein the steel wire further satisfies at least one or more conditions selected from groups A to E described below, group A: the steel wire further comprises, in mass %, Mo: 3.0% or less, wherein Md30, which is expressed as Equation (b) described below, is −150 or less, $$Md30=413-462(C+N)-9.2Si-8.1Mn-9.5Ni-13.7Cr-18.5Mo-29Cu \quad (b),$$

where element symbols in Equation (b) mean the content (mass %) of each of the elements contained in steel, group B: the steel wire further comprises one or more elements, in mass %, selected from:

Nb: 1.0% or less,

V: 1.0% or less,

Ti: 1.0% or less,

W: 1.0% or less, and

Ta: 1.0% or less, group C: the steel wire further comprises, in mass %, Co: 3.0% or less, group D: the steel wire further comprises, in mass %, B: 0.015% or less, group E: the steel wire further comprises one or more elements, in mass %, selected from:

Ca: 0.01% or less,

Mg: 0.01% or less, and

REM: 0.05% or less.

5. The super non-magnetic soft stainless-steel wire coil according to claim 1, wherein a tensile strength of the steel wire is 650 MPa or less, and a reduction of an area at tensile rupture of the steel wire is 70% or more.

6. The super non-magnetic soft stainless-steel wire coil according to claim 4, wherein a tensile strength of the steel wire is 650 MPa or less, and a reduction of an area at tensile rupture of the steel wire is 70% or more.

7. The method for manufacturing a super non-magnetic soft stainless-steel wire coil according to claim 2, wherein the wire rod further satisfies at least one or more conditions selected from groups A to E described below, group A: the wire rod further comprises, in mass %, Mo: 3.0% or less, wherein Md30, which is expressed as Equation (b) described below, is −150 or less, $$Md30=413-462(C+N)-9.2Si-8.1Mn-9.5Ni-13.7Cr-18.5Mo-29Cu \quad (b),$$

where element symbols in Equation (b) mean the content (mass %) of each of the elements contained in steel, group B: the wire rod further comprises one or more elements, in mass %, selected from:

Nb: 1.0% or less,

V: 1.0% or less,

Ti: 1.0% or less,

W: 1.0% or less, and

Ta: 1.0% or less, group C: the wire rod further comprises, in mass %, Co: 3.0% or less, group D: the wire rod further comprises, in mass %, B: 0.015% or less, group E: the wire rod further comprises one or more elements, in mass %, selected from:

Ca: 0.01% or less,

Mg: 0.01% or less, and

REM: 0.05% or less.

* * * * *